US006658900B2

(12) United States Patent
Okamoto

(10) Patent No.: US 6,658,900 B2
(45) Date of Patent: Dec. 9, 2003

(54) METHOD OF JOINING KNITTED FABRICS AND JOINED KNITTED FABRIC

(75) Inventor: Kazuyoshi Okamoto, Gose (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/275,288

(22) PCT Filed: May 16, 2001

(86) PCT No.: PCT/JP01/04087

§ 371 (c)(1),
(2), (4) Date: Nov. 13, 2002

(87) PCT Pub. No.: WO01/88243

PCT Pub. Date: Nov. 22, 2001

(65) Prior Publication Data

US 2003/0106344 A1 Jun. 12, 2003

(30) Foreign Application Priority Data

May 17, 2000 (JP) ..... 2000-145458

(51) Int. Cl.[7] ..... A61B 5/02
(52) U.S. Cl. ..... 66/64
(58) Field of Search ..... 66/64, 70, 176, 66/169 R, 60 R, 172 R, 171, 69, 75.1, 189, 175

(56) References Cited

U.S. PATENT DOCUMENTS 3,474,643 A * 10/1969 Robinson et al. ..... 66/70
3,640,097 A * 2/1972 Betts et al. ..... 66/176
3,695,063 A * 10/1972 Betts et al. ..... 66/176
3,702,068 A * 11/1972 Betts et al. ..... 66/176
3,882,697 A * 5/1975 Betts et al. ..... 66/176
4,197,724 A * 4/1980 Robinson et al. ..... 66/176
5,826,445 A * 10/1998 Okamoto ..... 66/70

FOREIGN PATENT DOCUMENTS

JP 3-75656 2/1991

* cited by examiner

*Primary Examiner*—Danny Worrell
(74) *Attorney, Agent, or Firm*—Rothwell, Figg, Ernst & Manbeck

(57) ABSTRACT

A method for knitting and joining together at least two tubular fabrics by using a flat knitting machine. The method includes a step of laying loops of a final course in a joining region of a first tubular fabric, which comprise a number of wale and are located at a side end portion thereof, and loops of a final course in a joining region of a second tubular fabric are laid over each other such that the loops located at a near side from a boundary between a front knitted fabric part and a back knitted fabric part are combined with each other and the loops located at a far side are combined with each other, thereby a machi is formed at a joining point of the tubular fabrics. The method also includes a step of knitting an integrated tubular fabric continuously from the joined tubular fabric.

12 Claims, 16 Drawing Sheets

METHOD OF JOINING KNITTED FABRICS AND JOINED KNITTED FABRIC

TECHNICAL FIELD

The present invention relates to a knitted fabric joining method for forming machi (godets) at joints of tubular fabrics and to a joined knitted fabric.

BACKGROUND ART

Knit goods have parts, called machi (godets), formed at joints thereof. The machi are formed at underarms and crotches of the knit goods, to add more profound or depth to knit goods of a two-dimensional knitted fabric and produce the knit good suitable to one's figure and comfortable to wear.

In the following, a known method for forming machi 103*a*, 103*b* in a sweater 101 in knitting on a knitting machine will be described with reference to FIG. 15. The sweater 101 comprises right and left sleeves 104, 105 comprising front sleeves 104*a*, 105*a* and back sleeves 104*b*, 105*b* and a body 106 comprising a front body 106*a* and a back body 106*b*. In the step A, the body 106 is knitted from a rib 109, and the sleeves 104, 105 are knitted from cuffs 111, 113 in the direction indicated by an arrow Q. In the step B, the right and left sleeves 104, 105 and the body 106 are each independently knitted in a tubular form until the sleeves 104, 105 and the body 106 are joined together at the underarms of the sweater 101. The right and left sleeves 104, 105 and the body 106 are knitted up to the underarms at which they are abutted with each other, while their knitting widths are gradually increased. In the step C of the joining process for forming the machi (godets) 103*a*, 103*b*, the yarn is fed shuttlewise to the sleeves 104, 105, and whenever an appropriate number of courses are knitted in the sleeve 104, 105, each of the sleeves 104, 105 is shifted toward the body. Then, loops of the sleeves 104, 105 at their side ends on the body side are laid over loops of the body 106, and then loops of the next course are formed at those double loops. Then, the newly formed loops are further laid over the loops at the interior side thereof and the next loops at the side ends of the sleeves 104, 105. This knitting is repeated to form the machi 103*a*, 103*b* and the line ZY of the sleeve 104 and the line z-y of the body 106 are joined together. In the step D, after the completion of forming the machi 103*a*, 103*b*, the yarn is fed circularly to the right and left sleeves 104, 105 and the body 106, and whenever an appropriate number of courses are knitted in the sleeve 104, 105, each of the sleeves 104, 105 is shifted toward the body to join together the line Y-X of the sleeve and the line y-x of the body 106. In the next step E, the yarn feed to the sleeves 104, 105 is stopped at the joints at which the upper end line X-W of the sleeves 104, 105 and the line x-w of the body are joined together, and whenever an appropriate number of courses are knitted in the body 106, each of the sleeves 104, 105 is shifted toward the body to join together the sleeves 104, 105 and the body 106. In the sweater 101 knitted in this manner, the sleeves 104, 105 are joined to the body 106 in the step C, while the loops in the next course are formed in the sleeves 104, 105. Thus, regions R are formed in the sleeves 104, 105, and the lines Z-Y of the sleeves 104, 105, and the lines z-y of the body are joined together. As a result of the sleeves and the body being joined together in this manner, when the sleeves 104, 105 are rotated from the body 106 centered on the machi 103*a*, 103*b* and spread out therefrom, the sleeves 104, 105 cannot rotate further from their right-angled intersection with the body, as shown in FIG. 16 showing the top positions of the sleeves 104, 105 of the sweater 101. This causes a restraint on free motion of the human body when wearing and provides uncomfortableness to wear. For convenience of explanation, FIG. 16 shows the uppermost positions of sleeves 104, 105 when rotated from the body 106, centered on the machi 103*a*, 103*b*, and spread out up to their top positions, without taking any account of their joining relation to the body 106.

It is an object of the present invention to disclose a knitted fabric joining method wherein one tubular fabric to be joined to form the machi can be allowed to rotate up to a larger angle than its right-angled intersection with the other tubular fabric in the direction in which the distance between the both knitted fabrics increases, and a knitted fabric comprising tubular fabrics which are joined together in such a manner that one tubular fabric can rotate up to a larger angle than its right-angled intersection with the other tubular fabric in the direction in which the distance between the both knitted fabrics increases. It is another object of the present invention to disclose knitwear of a high degree of freedom of motion of the human body

DISCLOSURE OF THE INVENTION

To accomplish the objects mentioned above, the present invention provides a knitted fabric joining method for knitting at least two tubular fabrics, each comprising front and back knitted fabric parts opposite to each other in front and back, and joining together the at least two tubular fabrics in an overlapping relation by using a flat knitting machine comprising at least a pair of first and second needle beds, which are extended laterally and confront each other in front and back; each of which has a large number of needles; and at least either of which can be racked laterally to transfer loops between the front and back needle beds, the method comprising a knitted fabric joining step that loops of a final course in a joining region of a tubular fabric to be joined, which comprise a proper number of wale and are located at a side end portion thereof, and loops of a final course in a joining region of another tubular fabric are laid over each other in such a relation that the loops located at near side from a boundary between the front knitted fabric part and the back knitted fabric part are combined with each other and the loops located at far side therefrom are combined with each other, so as to be bound off, whereby a machi is formed at a joining point of the two tubular fabrics, and an integrated tubular fabric is knitted continuously from that joined tubular fabric.

The knitted fabric joining method of the present invention may comprise the steps:

a) that in the process of knitting first and second knitted fabrics in a half-gauge knitting and joining together those knitted fabrics, one of first and second needle beds is racked in a first direction with respect to the other needle bed and then a loop of the first knitted fabric at a side end thereof on the second knitted fabric side, which loop is retained on the first needle bed, is transferred to outside of a loop of the first knitted fabric at a side end thereof retained on the second needle bed and a loop of the first knitted fabric at a side end thereof opposite to the side end on the second knitted fabric side, which loop is retained on the second needle bed, is transferred to outside of a loop of the first knitted fabric at the side end thereof retained on the first needle bed, this knitting being repeated, whereby the first knitted fabric is made to circle in the first direction so that the loops in the joining region of the first knitted fabric can all be retained on the second needle bed, b) that the one needle bed is racked in the first direction and then a loop of the second knitted fabric at a side end thereof on the first knitted fabric side, which loop is retained on the second needle bed, is transferred to outside of a loop of the second knitted fabric at a side end thereof retained on the first needle bed and a loop of the second knitted fabric at a side end thereof opposite to the side end on the first knitted fabric side, which loop is retained on the first needle bed, is transferred to outside of the loop of the second knitted fabric at a side end thereof retained on the second needle bed, this knitting being repeated, whereby the second knitted fabric is made to circle in the first direction so that the loops in the joining region of the second knitted fabric can all be retained on the first needle bed, c) that the loops of the first knitted fabric are all retained on the first needle bed; the loops of the second knitted fabric are all retained on the second needle bed; after the one needle bed is racked in the first direction so that a loop in the joining region of the first knitted fabric and a loop in the joining region of the second knitted fabric can correspond in position to each other in front and back, the loops in the joining regions of the first and second knitted fabrics are laid over each other so as to be bound off, and d) that the one needle bed is racked in the second direction and then a loop of the tubular fabric into which the first knitted fabric and the second knitted fabric are joined and which is retained on the second needle bed is transferred to outside of a loop of the tubular fabric at a side end thereof retained on the first needle bed and a loop of the tubular fabric at a side end thereof opposite to the side end on the first needle bed is transferred to outside of a loop of the tubular fabric at a side end thereof on the second needle bed, whereby the tubular fabric is made to circle in the second direction opposite to the first direction.

The knitted fabric joining method of the present invention may comprise the steps:

a) that the front knitted fabric part of the first knitted fabric is transferred to the second needle bed and the back knitted fabric part of the second knitted fabric is transferred to the first needle bed, b) that while either of the front needle bed and the back needle bed is racked in a lateral direction, loops in the joining region of the front knitted fabric part of the first knitted fabric are sequentially laid over loops of the front knitted fabric part of the second knitted fabric at a side end thereof, in parallel with loops in the joining region of the front knitted fabric part of the second knitted fabric being bound off in the direction of being away from the first knitted fabric, and c) that while either of the front needle bed and the back needle bed is racked in the lateral direction, loops in the joining region of the back knitted fabric part of the second knitted fabric are sequentially laid over loops of the back knitted fabric part of the first knitted fabric at a side end thereof, in parallel with loops in the joining region of the back knitted fabric part of the first knitted fabric being bound off in the direction of being away from the second knitted fabric, whereby the first knitted fabric and the second knitted fabric are joined together.

4. The knitted fabric joining method according to claim 1, which comprises the steps:

a) that the first knitted fabric, the second knitted fabric and a third knitted fabric are knitted in such a relation that the first knitted fabric can be positioned between the second and third knitted fabrics, and the front knitted fabric part of the second knitted fabric is transferred to the first needle bed and the back knitted fabric part of the third knitted fabric is transferred to the second needle bed, b) that while either of the front needle bed and the back needle bed is racked in a first direction, the knitting wherein loops in the joining region of the front knitted fabric part of the first knitted fabric on the second knitted fabric side are bound off in the direction of being away from the second knitted fabric and the knitting wherein loops in the joining region of the front knitted fabric part of the second knitted fabric and loops of the front knitted fabric part of the first knitted fabric at a side end thereof are laid over each other are performed in parallel, and the knitting wherein loops in the joining region of the back knitted fabric part of the first knitted fabric on the third knitted fabric side are bound off in the direction of being away from the third knitted fabric and the knitting wherein loops in the joining region of the back knitted fabric part of the third knitted fabric and loops of the back knitted fabric part of the first knitted fabric at a side end thereof are laid over each other are performed in parallel, c) that the back knitted fabric part of the second knitted fabric is transferred to the second needle bed and the front knitted fabric part of the third knitted fabric is transferred to the first needle bed, and d) that while the either needle bed is racked in a second direction, the knitting wherein loops in the joining region of the back knitted fabric part of the first knitted fabric on the second knitted fabric side are bound off in the direction of being away from the second knitted fabric and the knitting wherein loops in the joining region of the back knitted fabric part of the second knitted fabric and loops of the back knitted fabric part of the first knitted fabric at a side end thereof are laid over each other are performed in parallel, and the knitting wherein loops in the joining region of the front knitted fabric part of the first knitted fabric on the third knitted fabric side are bound off in the direction of being away from the third knitted fabric and the knitting wherein loops in the joining region of the back knitted fabric part of the third knitted fabric and loops of the front knitted fabric part of the first knitted fabric at a side end thereof are laid over each other performed in parallel at both ends of the first knitted fabric.

The knitted fabric joining method of the present invention may comprise the steps:

a) that one of first and second needle beds is racked in a first direction with respect to the other needle bed and then a loop of the first knitted fabric at a side end thereof on the second knitted fabric side, which loop is retained on the first needle bed, is transferred to outside of a loop of the first knitted fabric at a side end thereof retained on the second needle bed and a loop of the first knitted fabric at a side end thereof opposite to the side end on the second knitted fabric side, which loop is retained on the second needle bed, is transferred to outside of the loop located at the side end of the first knitted fabric retained on the first needle bed, this knitting being repeated, so that the first knitted fabric is made to circle in the first direction so that the loops in the joining region of the first knitted fabric can all be retained on the second needle bed, b) that the one needle bed is racked in the second direction and then a loop of the second knitted fabric at a side end thereof on the first knitted fabric side, which loop is retained on the first needle bed, is transferred to outside of a loop of the second knitted fabric at a side end thereof retained on the second needle bed and a loop of the second knitted fabric at a side end thereof opposite to the side end on the first knitted fabric side, which loop is retained on the second needle bed, is transferred to outside of the loop located at the side end of the second knitted fabric retained on the first needle bed, this knitting being repeated, so that the second knitted fabric is made to circle in the second direction so that the loops in the joining region of the second knitted fabric can all be retained on the second needle bed, c) that while either of front and back needle beds is racked in the first direction, the knitting wherein loops in the joining region of the first knitted fabric are bound off in the direction of being away from the second knitted fabric, and the knitting wherein loops in the joining region of the second knitted fabric and loops of the first knitted fabric at a side end thereof retained on the second needle bed are laid over each other are performed to join together the joining region of the second knitted fabric and the joining region of the first knitted fabric, and d) that while the either needle bed is racked in the second direction, a loop of the first knitted fabric retained on the first needle bed is transferred to outside of a loop of the first knitted fabric at a side end thereof retained on the second needle bed, and a loop of the first knitted fabric at a side end thereof retained on the second needle bed is transferred to outside of the loop of the first knitted fabric at a side end thereof retained on the first needle bed, this knitting being repeated, whereby the tubular fabric is made to circle in the first direction.

The knitted fabric joining method of the present invention may comprise the steps:

a) that the first knitted fabric, the second knitted fabric and a third knitted fabric are knitted in such a relation that the first knitted fabric can be positioned between the second and third knitted fabrics; and after one needle bed is racked in a first direction with respect to the other needle bed, a loop of the first knitted fabric at a side end thereof on the second knitted fabric side, which loop is retained on the second needle bed, is transferred to outside of a loop of the first knitted fabric at a side end thereof retained on the first needle bed and a loop of the first knitted fabric at a side end thereof on the third knitted fabric side, which loop is retained on the first needle bed, is transferred to outside of a loop of the first knitted fabric at a side thereof on the third knitted fabric side, which loop is retained on the second needle bed, this knitting being repeated, whereby the first knitted fabric is made to circle in the first direction so that the loops in the joining region of the first knitted fabric on the second knitted fabric side can be retained on the first needle bed and the loops in the joining region of the first knitted fabric on the third knitted fabric side can be retained on the second needle bed, b) that after the needle bed is racked in a second direction, the knitting (i) wherein a loop in a joining region of the second knitted fabric at a side end thereof on the first knitted fabric side, which loop is retained on the second needle bed, is transferred to outside of a loop of the second knitted fabric at a side end thereof retained on the first needle bed and a loop of the second knitted fabric at a side end thereof opposite to the first knitted fabric, which loop is retained on the first needle bed, is transferred to outside of a loop of the second knitted fabric at a side end thereof retained on the second needle bed, this knitting being repeated, whereby the second knitted fabric is made to circle in the second direction so that the loops in the joining region of the second knitted fabric can be retained on the first needle bed; and the knitting (ii) wherein a loop in a joining region of the third knitted fabric at a side end thereof on the first knitted fabric side, which loop is retained on the first needle bed, is transferred to outside of a loop of the third knitted fabric at a side end thereof retained on the second needle bed and a loop of the third knitted fabric at a side end thereof opposite to the first knitted fabric, which loop is retained on the second needle bed, is transferred to outside of a loop of the third knitted fabric at a side end thereof retained on the first needle bed, this knitting being repeated, whereby the third knitted fabric is made to circle in the second direction so that the loops in the joining region of the third knitted fabric can be retained on the second needle bed are performed in parallel, c) that while either of the front needle bed and the back needle bed is racked in the first direction, the knitting wherein loops in the joining region of the first knitted fabric on the second knitted fabric side are bound off in the direction of being away from the second knitted fabric and the knitting wherein loops in the joining region of the second knitted fabric and loops of the first knitted fabric at a side end thereof are laid over each other are performed in parallel, and the knitting wherein loops in the joining region of the first knitted fabric on the third knitted fabric side are bound off in the direction of being away from the third knitted fabric and the knitting wherein loops in the joining region of the third knitted fabric and loops of the first knitted fabric at a side end thereof are laid over each other are performed in parallel, and d) that while the either needle bed is racked in the second direction, the knitting wherein a loop of the tubular fabric at a side end thereof retained on the first needle bed, the tubular fabric being formed by joining together the first, second and third knitted fabrics, is transferred to outside of a loop of the tubular fabric at a side end thereof retained on the second bed, and a loop of the tubular fabric at a side end thereof retained on the second needle bed is transferred to outside of a loop of the tubular fabric at a side end thereof retained on the first needle bed, this knitting being repeated, whereby the tubular fabric is made to circle in the second direction.

In the knitted fabric joining method of the present invention, the joining of the joining regions of the front knitted fabric part and the joining of the joining regions of the back knitted fabric part may be performed independently and a circle knitting wherein a loop of the knitted fabric having a larger number of loops retained on either of the needle beds is transferred to outside of a loop of the knitted fabric retained on the opposite needle bed may be performed in parallel with the joining knitting.

In the knitted fabric joining method of the present invention, the joining between the first knitted fabric and the second knitted fabric and the joining between the first knitted fabric and the third knitted fabric and/or the joining of the front knitted fabric parts and the joining of the back knitted fabrics may be performed independently and a circle knitting wherein a loop of the knitted fabric having a larger number of loops retained on either of the needle beds is transferred to outside of a loop of the knitted fabric retained on the opposite needle bed may be performed in parallel with the joining knitting.

In the knitted fabric joining method of the present invention, the number of loops in the joining region of the front knitted fabric part and the number of loops in the joining region of the back knitted fabric may be made different from each other.

Also, the present invention provides a knitted fabric formed by joining together at least two tubular fabrics, each comprising front and back knitted fabric parts knitted opposite to each other in front and back, by using a flat knitting machine comprising at least a pair of first and second needle beds, which are extended laterally and confront each other in front and back; each of which has a large number of needles; and at least either of which can be racked laterally to transfer loops between the front and back needle beds, wherein loops of a final course in a joining region of a tubular fabric to be joined, which comprise a proper number of wale and are located at a side end portion thereof, and loops of a final course in a joining region of another tubular fabric are laid over each other in such a relation that the loops located at near side from a boundary between the front knitted fabric part and the back knitted fabric part are combined with each other and the loops located at far side therefrom are combined with each other, and are bound off, whereby a machi is formed in the knitted fabric and an integrated tubular fabric knitted continuously from that joined tubular fabric.

In the knitted fabric of the present invention, the at least two tubular fabrics may be in the form of a right leg part and a left leg part of a legwear.

In the knitted fabric of the present invention, the at least two tubular fabrics may be in the form of a body and right and left sleeves of a sweater.

Now, operation of the present invention will be described.

According to the present invention, in the process for knitting at least two tubular fabrics and joining together them, the loops of the final course in the joining region of the tubular fabric to be joined, which comprise a proper number of wale and are located at a side end portion thereof, and the loops of the final course in the joining region of another tubular fabric are laid over each other in such a relation that the loops located at near side from the boundary between the front knitted fabric part and the back knitted fabric part are combined with each other and the loops located at far side therefrom are combined with each other, so as to be bound off, whereby the at least two tubular fabrics are joined together.

According to one method for joining together the tubular fabrics, the tubular fabrics knitted in the half-gauge knitting are made to circle in the same direction in the circle knitting as mentioned later, whereby the loops in the joining regions of both front and back knitted fabric parts of one tubular fabric are retained on the front needle bed and the loops of another tubular fabric are retained on the back needle bed, so that the loops of the joining regions of the both knitted fabrics are bound off at the same time. In this joining method, the joining of the joining regions of the front knitted fabric part and the joining region of the back knitted fabric part are performed sequentially.

In another method for joining together the tubular fabrics, the knitting wherein one knitted fabric to be joined is bound off from one side end thereof toward the other end thereof and the knitting wherein the loops in the joining regions of another tubular fabric are laid over each other from a side end thereof in such a relation that the front knitted fabric parts are combined with each other and the back knitted fabric parts are combined with each other are performed concurrently. In this joining method, the knitting wherein the loops in the joining regions are laid over each other and the knitting for the bind-off process are performed concurrently, while the joining of the joining regions of the front knitted part and the joining of the joining regions of the back knitted part are performed independently.

In still another joining method, the tubular fabrics to be joined together are made to circle in the opposite direction in the circle knitting so that the loops in the joining regions of both tubular fabrics are retained on the same needle bed and, thereafter, one knitted fabric to be joined is bound off from one side end portion thereof toward the other end and the loops in the joining region of another tubular fabric are laid over each other and joined to each other from a loop at the side end in such a relation that the front knitted fabric parts are combined with each other and the back knitted fabric parts are combined with each other. In this knitting method, the knitting wherein the loops in the joining regions are laid over each other and the knitting for the bind-off process are performed in parallel, while the joining of the joining regions of the front knitted parts and the joining of the joining regions of the back knitted parts are performed in sequence.

In the case where difference in the number of loops retained on the needle beds is produced, for example, by the joining of the front knitted fabric part and the body part and the joining of the back knitted fabric part and the body part being performed in a sequential order or by three or more tubular fabrics being joined together in such a manner that the joining of each pair of opposing tubular fabrics are performed independently, a loop of the knitted fabric having a larger number of loops retained on either of the needle beds is transferred to outside of a loop of the knitted fabric at a side end thereof retained on the opposite needle bed in the circle knitting, to prevent widening of difference in the number of loops retained on the both needle beds, for the knitting for joining together the knitted fabrics.

BRIEF DESCRIPTION OF THE DRAWINGS

FIGS. 5-*b* and 5-*c* diagrams illustrating the knitting steps of the second embodiment for forming the machi in the sweater.

BEST MODE FOR CARRYING OUT THE INVENTION

In the following, certain preferred embodiments of the present invention will be described in detail with reference to the accompanying drawings. In the embodiment mentioned below, a two-bed flat knitting machine is used wherein front and back needle beds, each having a large number of needles arranged in series thereon, are disposed to confront each other and the back needle bed is so structured as to be racked laterally so that the stitch transfer can be made between the front and back needle beds. In another embodiment, a four-bed flat knitting machine mentioned later is used wherein upper front needle bed and upper back needle bed, each having a large number of needles arranged in series at the same pitches as in the lower needle beds, are disposed over the lower front needle bed and lower back needle bed, respectively, and which is structured so that the stitch transfer can be made between the lower front needle bed and the lower back needle bed and between the confronting lower and upper needle beds. In either of the embodiments, the flat knitting machine used is structured so that the back needle bed can be racked laterally relative to the front needle bed.

Figure 1:
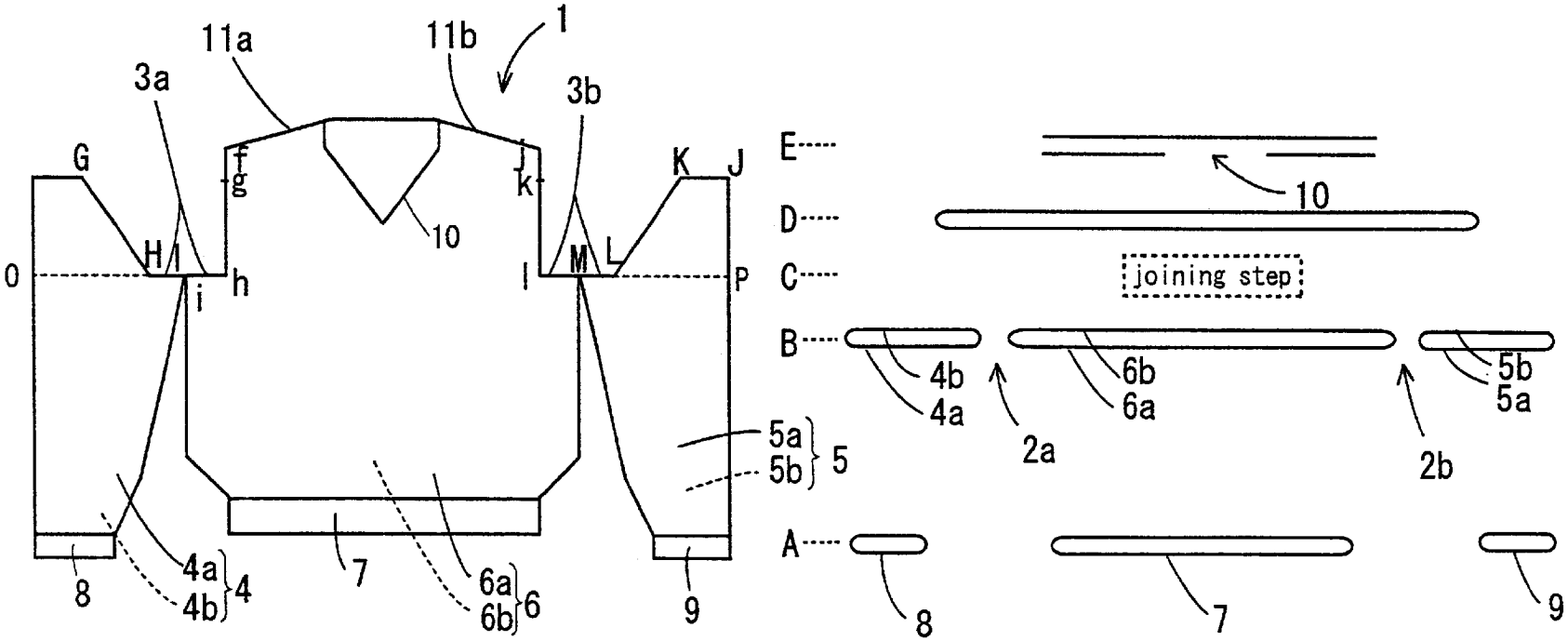
FIG. 1 shows a development of a sweater in which machi are formed and a knitting process drawing of the same.
Figure 2:
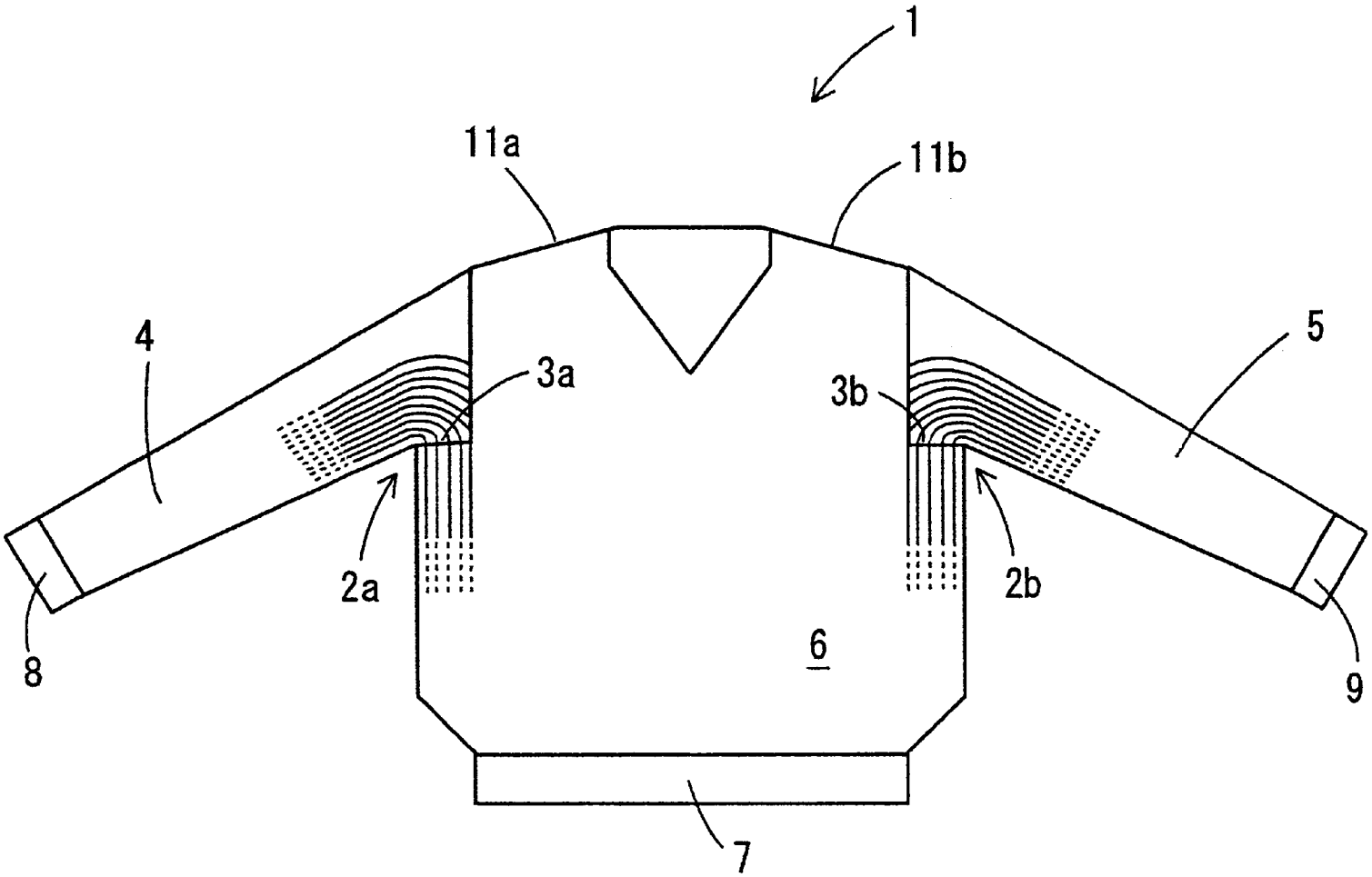
FIG. 2 is a completion drawing of the sweater 1 of FIG. 1.

FIG. 1 shows a development of a sweater 1 in which machi 3*a*, 3*b* are formed at underarms 2*a*, 2*b* in the knitted fabric joining method of this embodiment and a knitting process drawing of the same. FIG. 2 is a completion drawing of the sweater 1 of FIG. 1. In FIG. 2, the direction of wale of sleeves 4, 5 and the direction of wale of a body 6 are shown around the machi 3*a*, 3*b*. In the step A, the knitting of the sweater 1 starts from the rib 7 of the body 6 and the cuffs 8, 9 of the both right and left sleeves 4, 5. In the step B, the sleeves 4, 5 and the body 6 are each knitted in the form of an independent tubular fabric before they are joined together at the underarms 2*a*, 2*b*. In the step C, after the sleeves 4, 5 are knitted up to the lines I-O and M-P, the line I-H of the right sleeve 4 and the line i-h of the body 6 are joined together and the line M-L of the left sleeve 5 and the line m-l of the body 6 are joined together in the joining step, to form the machi 3*a*, 3*b* thereat. In the next step D, while the right and left sleeves 4, 5 and the body 6 are knitted in the form of a single tubular fabric, the sleeves 4, 5 are shifted toward the body 6, so that the line G-H of the right sleeve 4 and the g-h of the body 6 are joined together and the line L-K of the left sleeve and the line l-k of the body are joined together. In the step E in which the line F-G of the right sleeve 4 and the line f-g of the body 6 are joined together and the line J-K of the left sleeve 5 and the line j-k of the body 6 are joined together, the feed of the yarn to the sleeves 4, 5 is ended, and whenever an appropriate number of courses are knitted in the body 6, each of the sleeves 4, 5 is shifted toward the body 6, so that the sleeves 4, 5 and the body 6 are joined together. After the completion of joining together the sleeves 4, 5 and the body 6, the front body 6*a* having a collar opening 10 formed therein and the back body 6*b* are joined together at right and left shoulders 11*a*, 11*b*, so as to bring the sweater 1 to completion. In the following, three different methods for forming the machi 3*a*, 3*b* in joining together the sleeves 4, 5 and the body 6 will be recited as Examples 1 to 3. As the knitting processes are all known, except the joining process, only the joining process will be discussed here.

First Embodiment

The first embodiment will be described with reference to FIG. 3. The first embodiment provides the method in which a tubular fabric knitted in the half gauge knitting is made to circle in the same direction in the circle knitting as defined later, whereby loops in both joining regions of one of the front and back knitted fabrics of the tubular fabric which are retained on the front needle bed and loops in both joining regions of the other of the front and back knitted fabrics of the tubular fabric which are retained on the back needle bed are laid over each other and also bound off concurrently. In the first embodiment, the joining of the joining regions of the front knitted fabric and the joining of the joining regions of the back knitted fabric are performed sequentially. In the first embodiment, a two-bed flat knitting machine is used for the half gauge knitting wherein the needles used for the front knitted fabric comprising a front body 6*a*, a front right sleeve 4*a* and a front left sleeve 5*a* and the needles used for the back knitted fabric comprising a back body 6*b*, a back right sleeve 4*b* and a back left sleeve 5*b* are arranged alternately so that the front knitted fabric and the back knitted fabric can be formed with the alternately arranged needles. In the half gauge knitting, when the front knitted fabric is knitted, the back knitted fabric is retained on (associated with) the back needle bed, while on the other hand, when the back knitted fabric is knitted, the front knitted fabric is associated with the front needle bed, so that the knitted fabrics are knitted in the state in which they are placed opposite in front and back. As the details about the half gauge knitting is disclosed, for example, by Japanese Patent Publication No. Hei 3 (1991)-75656, further details about the half gauge knitting is omitted. This half gauge knitting can provide the result that empty needles for transfer of loops of the knitted fabrics can always be reserved for the respective knitted fabrics on the opposed needle beds. The use of the empty needles enables the knitting of the structure pattern in which front stitches and back stitches are mixed, such as links, garter and rib, and also enables the loops of the sleeves and bodies to be shifted laterally to be joined to each other.

The joining method of the first embodiment can be used to knit leg wears comprising two tubular fabrics joined, such as pants and tights, and knit items comprising three joined tubular fabrics joined, such as sweater. In the following, the joining of the three tubular fabrics will be described, taking the sweater 1 of FIG. 1 for example.

Figure 3:
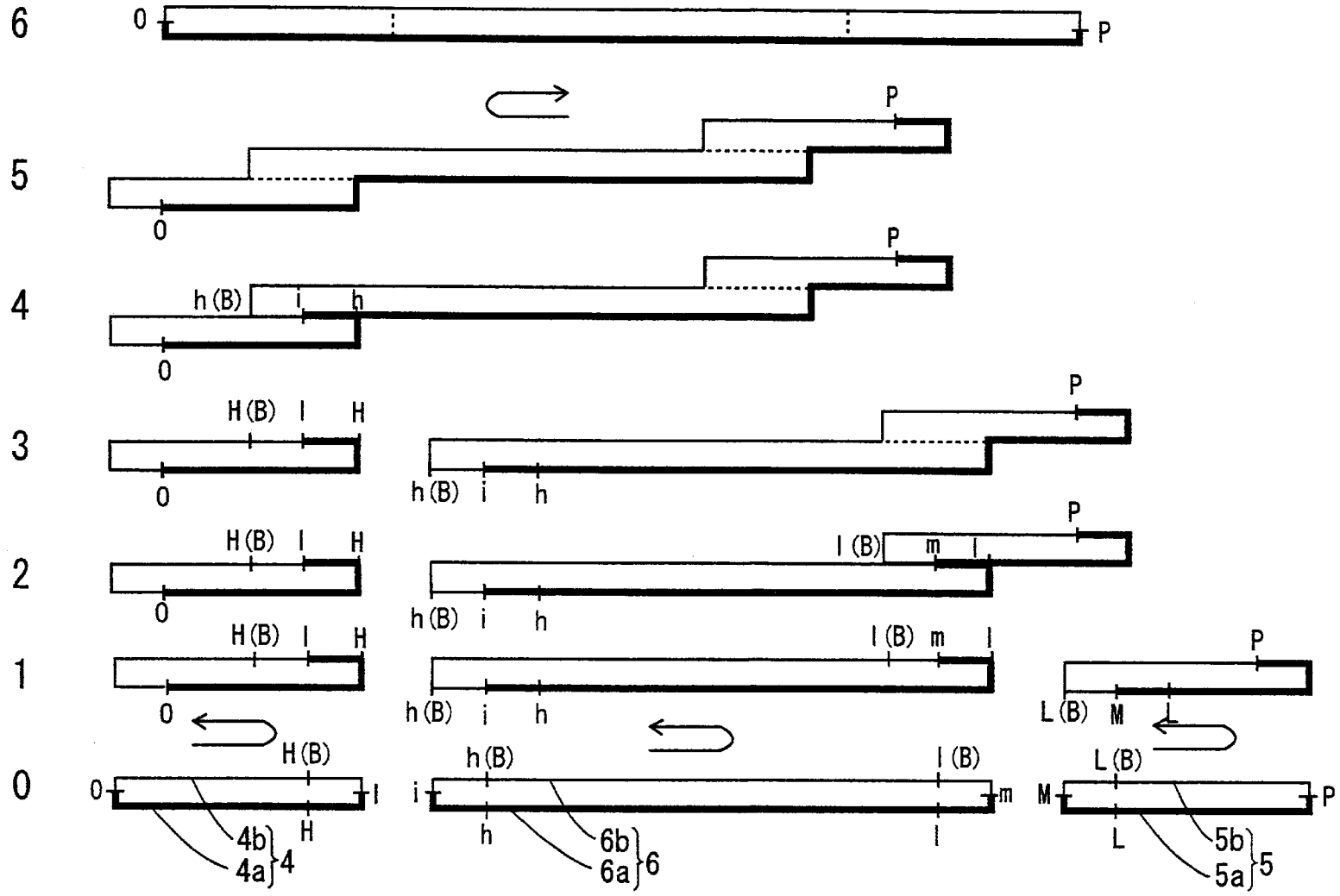
FIG. 3 is a diagram illustrating the knitting steps of the first embodiment for forming the machi in the sweater.

The step 0 of FIG. 3 illustrates the state in which the body 6 is knitted up to the line i-m; the right sleeve 4 is knitted up to the line O-I; and the left sleeve 5 is knitted up to the line P-M. The front knitted fabric is depicted by a bold line, and the back knitted fabric is depicted by a thin line. The front knitted fabric comprising the front body 6*a*, the front right sleeve 4*a* and the front left sleeve 5*a* and the back knitted fabric comprising the back body 6*b*, the back right body 4*b* and the back left body 5*b* are retained on the front and back needle beds, respectively. The alphabets in FIG. 3 correspond to the alphabets at the points of the sweater of FIG. 1. The points on the back knitted fabric is labeled (B).

Figure 4:
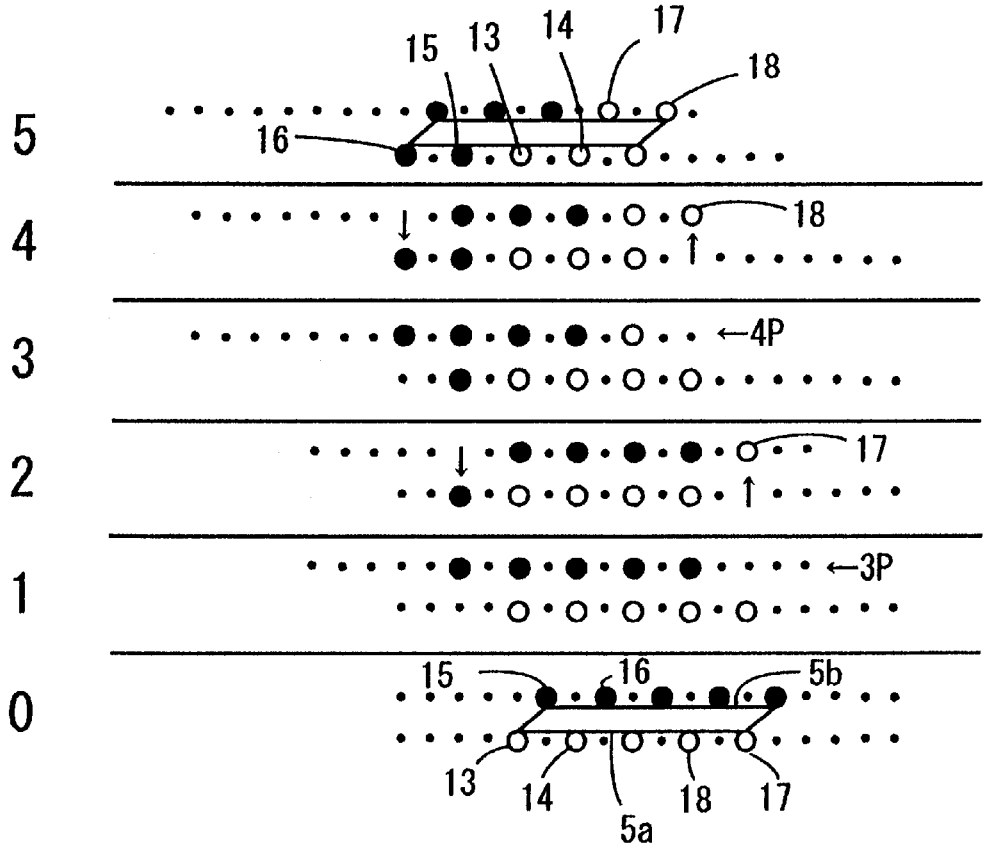
FIG. 4 is a diagram illustrating a circle knitting.

In the step C of the joining process for forming the machi 3*a*, 3*b*, after the back needle bed is racked leftward in the step 0-1 of FIG. 3, the loops of the front body 6*a*, front right sleeve 4*a* and front left sleeve 5*a* at the right side ends thereof are transferred to the empty needles of the back needle bed located at the outside of the loops of the back knitted fabric at the side ends thereof. Similarly, the loops of the back knitted fabric comprising the back body 6*b*, back right sleeve 4*b* and back left sleeve 5*b* at the left side ends thereof are transferred to the empty needles of the front needle bed located at the outside of the loops of the front knitted fabric at the side ends thereof. Subsequently, whenever the back needle bed is further racked leftward at a proper pitch, the loops of the front knitted fabric at the right side end are transferred to the back needle bed and the loops of the back knitted fabric at the left side end are transferred to the front needle bed. Then, the body 6 and the right and left sleeves 4, 5 are rotated a required distance in the counterclockwise direction, for the circle knitting. As a result of this circle knitting, the loops in the joining region of the left sleeve 5 are all retained on the front needle bed; the loops in the joining region of the right sleeve 4 are retained on the back needle bed; and the loops in the joining region of the body 6 on the left sleeve side and the loops in the region of the body 6 on the right sleeve side are retained on the back needle bed and the front needle bed, respectively. It should be noted that the terminology of "the circle knitting" used herein is intended to mean the knitting way in which a loop of the tubular fabric at a side end portion thereof retained on one of the beds is transferred to outside of a loop of the tubular fabric at a side end thereof retained on the opposite needle bed so that the knitted fabrics can be made to circle in the clockwise direction or in the counterclockwise direction. Description will be given of the circle knitting, with reference to FIG. 4 illustrating the knitting of the left sleeve 5. In the course 0 of FIG. 4 which shows the state of the step 0 of FIG. 3, the loops of the front left sleeve 5*a* are retained on alternate needles of the front needle bed and the loops of the back left sleeve 5*b* are retained on alternate needles of the back needle bed in such a relation that the phase of the back left sleeve 5*b* is shifted one needle pitch with respective to the phase of the front left sleeve 5*a*. The loops 13, 14 in the two wale of the front left sleeve 5*a* at the left side and the loops 15, 16 in the two wale of the back left sleeve 5*b* at the left side correspond to the loops in the joining regions. In the course 1, the back needle bed is racked leftward three pitches and, then, in the course 2, the loop 15 of the back left sleeve 5*b* at the left end is transferred to the front needle bed and the loop 17 of the front left sleeve 5*a* at the right end is transferred to the back needle bed. Subsequently, in the course 3, the back needle bed is further racked leftward four pitches and, then, in the course 4, the loop 16 at the left end retained on the back needle bed is transferred to the front needle bed and the loop 18 at the right end retained on the front needle bed is transferred to the back needle bed. As a result of this, the state of the course 5 is presented. The course 5 represents the left sleeve 5 in the step 1 of FIG. 3. The left sleeve 5 starts circling in the counterclockwise direction from the step 0 until the loops 13–16 in the joining regions are retained on the needles of the front needle bed.

Then, in the step 2 of FIG. 3, the loops of the front left sleeve 5*a* are all transferred to the empty needles of the back needle bed; the loops of the back body 6*b* are all transferred to the empty needles of the front needle bed; and the loops of the back right sleeve 4*b* retained on the back needle bed are all transferred to the front needle bed, so that the left sleeve 5 is retained on the back needle bed and the right sleeve 4 and the body 6 are retained on the front needle bed. Then, the back needle bed is racked in the leftward direction in which the left sleeve 5 comes near to the body 6, so that the joining region of the front left sleeve 5*a* is placed opposite to the joining region of the body 6 on its left sleeve side. Thereafter, the loops in the both joining regions are laid over each other to form a double loop. In the step 3, a yarn is fed to the needle retaining the double loop thereon from one end of the double loop toward the other end of the same, to form a new loop of the next course. Then, this newly formed loop is laid over the next double loop to form a triple loop. Subsequently, the yarn is fed to the triple loop to form a new loop of the next course. Further, this newly formed loop is laid over the next double loop. This knitting is repeated to prevent loosening of loops in the joining regions, which is called the bind-off process. Thereafter, the loops are released from the needles. The machi 3*b* is brought to completion in this manner. As the bind-off process is already known from the applicant's early application and others, the detailed description thereon is omitted. In the next step 4, after the loops of the body 6 retained on the front needle bed are all transferred to the back needle bed, the back needle bed is further racked leftward, so that the joining region of the right sleeve 4 is placed opposite to the joining region of the body 6 on its right sleeve 4 side and the loops in the both joining regions are laid over each other. In the next step 5, the double loops in the joining regions of the left sleeve 5 and the body 6 are bound off and, thereafter, the loops are released from the needles. The machi 3*a* is brought to completion in this manner. As a result of this, the right and left sleeves 4, 5 and the body 6 are knitted into one piece. In the next step 6, the loops at the right side end of the tubular fabric formed by combining the right and left sleeves 4, 5 with the body 6 are transferred to the empty needles of the front needle bed in the reverse order to the order from the step 0 to the step 1. Then, the loops at the left side end of the tubular fabric are transferred to the empty needles of the back needle bed. Then, whenever the back needle bed is racked rightward a proper pitch, the clockwise circle knitting in which the loop at the right side end of the tubular fabric is transferred to the front needle bed and the loop at the left side end of the tubular fabric is transferred to the front needle bed is performed until the boundaries O, P between the front body 6*a* and the back body 6*b* reach both ends of the fabric. Subsequently, the knitting in the step D and the subsequent step of FIG. 1 is performed to knit the sweater 1. It should be noted that in the case where two knitted fabrics are joined together, the knitting processes mentioned above may skip over the steps 4 and 5 to the step 6 from the step 3. In the illustrated embodiment, the body 6 and the sleeves 4, 5 are made to circle in the counterclockwise direction from the step 0 to the step 1 and the tubular fabric formed by combining the right and left sleeves 4, 5 with the body 6 is made to circle in the clockwise direction from the step 5 to the step 6. This embodiment may be modified so that the body 6 and the sleeves 4, 5 may be made to circle in the clockwise direction from the step 0 to the step 1 and the tubular fabric may be made to circle in the counterclockwise direction from the step 5 to the step 6. In the illustrated embodiment, the number of loops in the machi formed in the front knitted fabric and the number of loops in the machi formed in the back knitted fabric are identical with each other. The number of loops in the machi formed in the front knitted fabric and the number of loops in the machi formed in the back knitted fabric may be made different from each other.

Second Embodiment

The second embodiment will be described with reference to FIGS. 5–12. The second embodiment provides the method in which the knitting process in which one knitted fabric to be joined is subjected to the bind-off process is performed from one side end thereof toward the other side end and the knitting process in which the loops in the joining region of another knitted fabric of the tubular fabric are sequentially laid over the loops in the joining region of the one knitted fabric from a side end thereof in such a manner that a front knitted fabric part of the one knitted fabric and a front knitted fabric part of another knitted fabric are overlapped with each other and a back knitted fabric part of the one knitted fabric and a back knitted fabric part of another knitted fabric are overlapped with each other proceed concurrently. In the second embodiment, the knitting process in which the loops in the joining regions are laid over each other and the bind-off process proceed concurrently, and the process for joining together the adjacent joining regions of the front knitted fabric parts and the process for joining together the adjacent joining regions of the back knitted fabric parts proceed independently.

Figure 5:
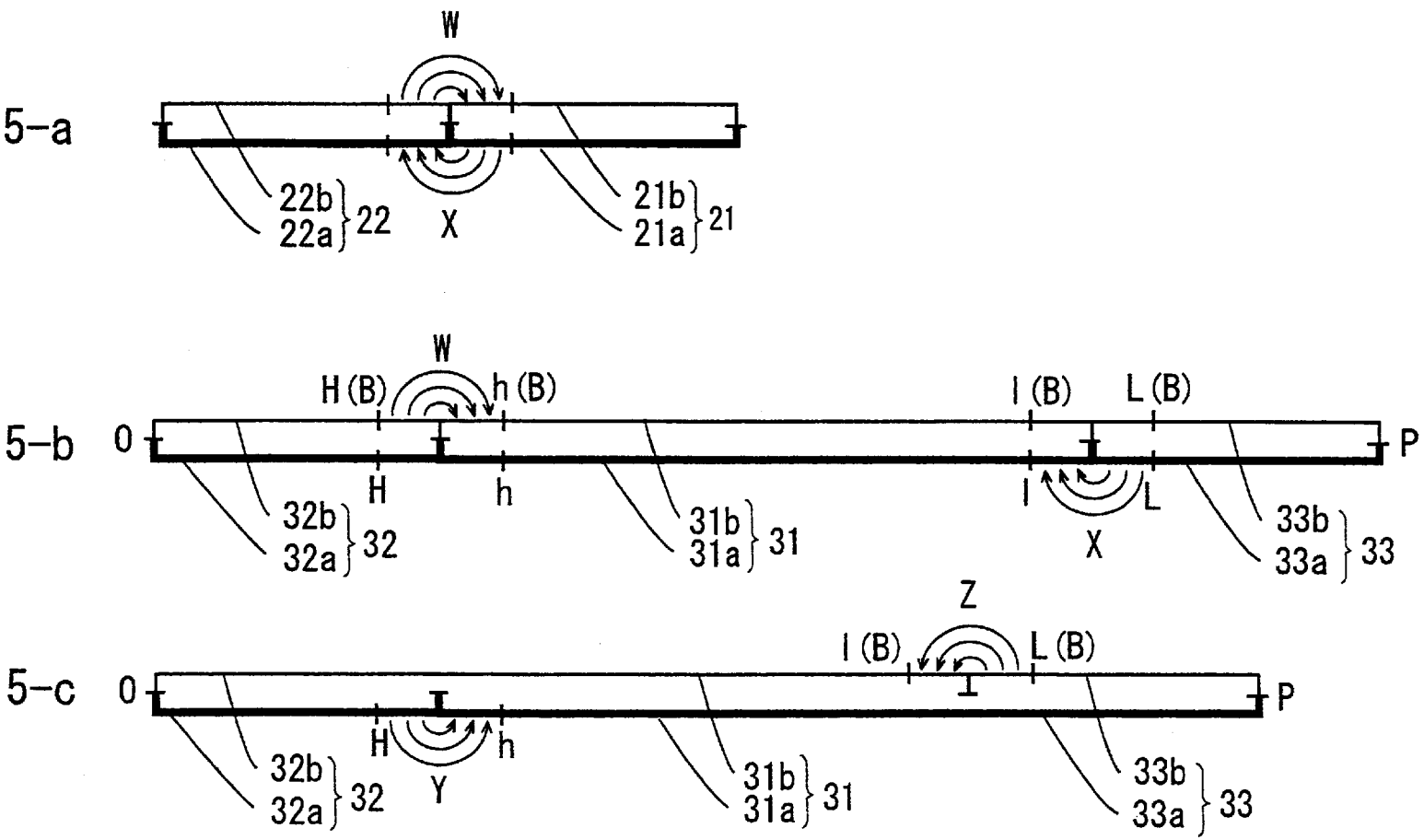
FIG. 5-*a* is diagram illustrating the knitting steps of the second embodiment for forming the machi in a short pant.

In the second embodiment, a four-bed flat knitting machine is used for the joining method of the invention, though the two-bed flat knitting machine can be used therefor by doing the half gauge knitting. In the second embodiment, two different knitting processes are taken for the process for joining together two knitted fabrics and the process for joining together three knitted fabrics, respectively. These knitting processes will be outlined with reference to FIG. 5. FIG. 5-*a* illustrates the knitting process for joining together the two knitted fabrics; FIGS. 5-*b* and 5-*c* illustrate the knitting process for joining together the three knitted fabrics. In the process for joining together the two knitted fabrics, the knitting X wherein a front part 21*a* of a first knitted fabric 21 is moved to a front part 22*a* of a second knitted fabric 22, for the joining process; and the knitting W wherein a back part 22*b* of the second knitted fabric 22 is moved to a back part 21*b* of the first knitted fabric 21, for the joining process, are taken to form the machi 3*a*, 3*b*. The knitting W and the knitting X may proceed concurrently or sequentially. In the case where the knitting W and the knitting X proceed concurrently, the number of times for the beds to be racked can be reduced, thus providing the advantage of providing the effective knitting. In the case where the knitting W and the knitting X proceed sequentially, the number of loops in the machi of the front knitted fabric and the number of loops in the machi of the back knitted fabric can be made different. In the latter case, the circle knitting may proceed in such a manner that the loops at the side end of the knitted fabric having an increased number of loops may be transferred to the outside of the loop located at the side end of the opposed knitted fabric to erase the difference in number of loops between the front knitted fabric part and the back knitted fabric part.

In the process for joining together the three knitted fabrics, the knitting W wherein a back part 32*b* of a second knitted fabric 32 is moved to a back part 31*b* of a first knitted fabric 31, for the joining process; the knitting X wherein a front part 33*a* of a third knitted fabric 33 is moved to a back part 31*b* of the first knitted fabric 31, for the joining process; the knitting Y wherein a front part 32*a* of the second knitted fabric 32 is moved to a front part 31*a* of the first knitted fabric 31, for the joining process; and the knitting Z wherein a back part 33*b* of the third knitted fabric 33 is moved to the front part 31*a* of the first knitted fabric 31, for the joining process, are taken to form the machi 3*a*, 3*b*. In the knitting W-Z, the knitting W-X and the knitting Y-Z may proceed in parallel with each other or the knitting W-Z may proceed in random order. In the case where the knitting W-X proceed in parallel, first, and, then, the knitting Y and Z proceed in parallel, or vice versa, the number of times for the beds to be racked can be reduced, thus providing the advantage of providing the effective knitting. In the case where the knitting proceeds in the descendent order of W-Z, the number of loops in the machi of the front knitted fabric and the number of loops in the machi of the back knitted fabric can be made different. In the latter case, the same circle knitting as the circle knitting for joining the two knitted fabric may proceed to erase the difference in number of loops between the front knitted fabric part and the back knitted fabric part.

Figure 6:
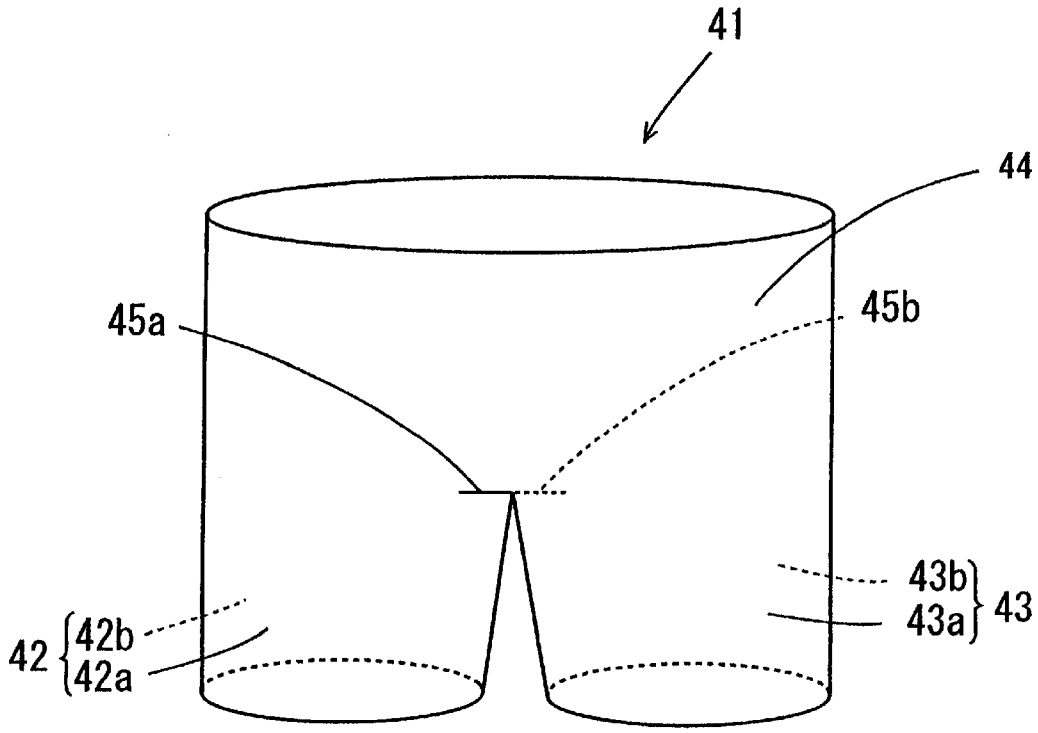
FIG. 6 shows the short pant formed by two knitted fabrics being joined together in the second embodiment.
Figure 7:
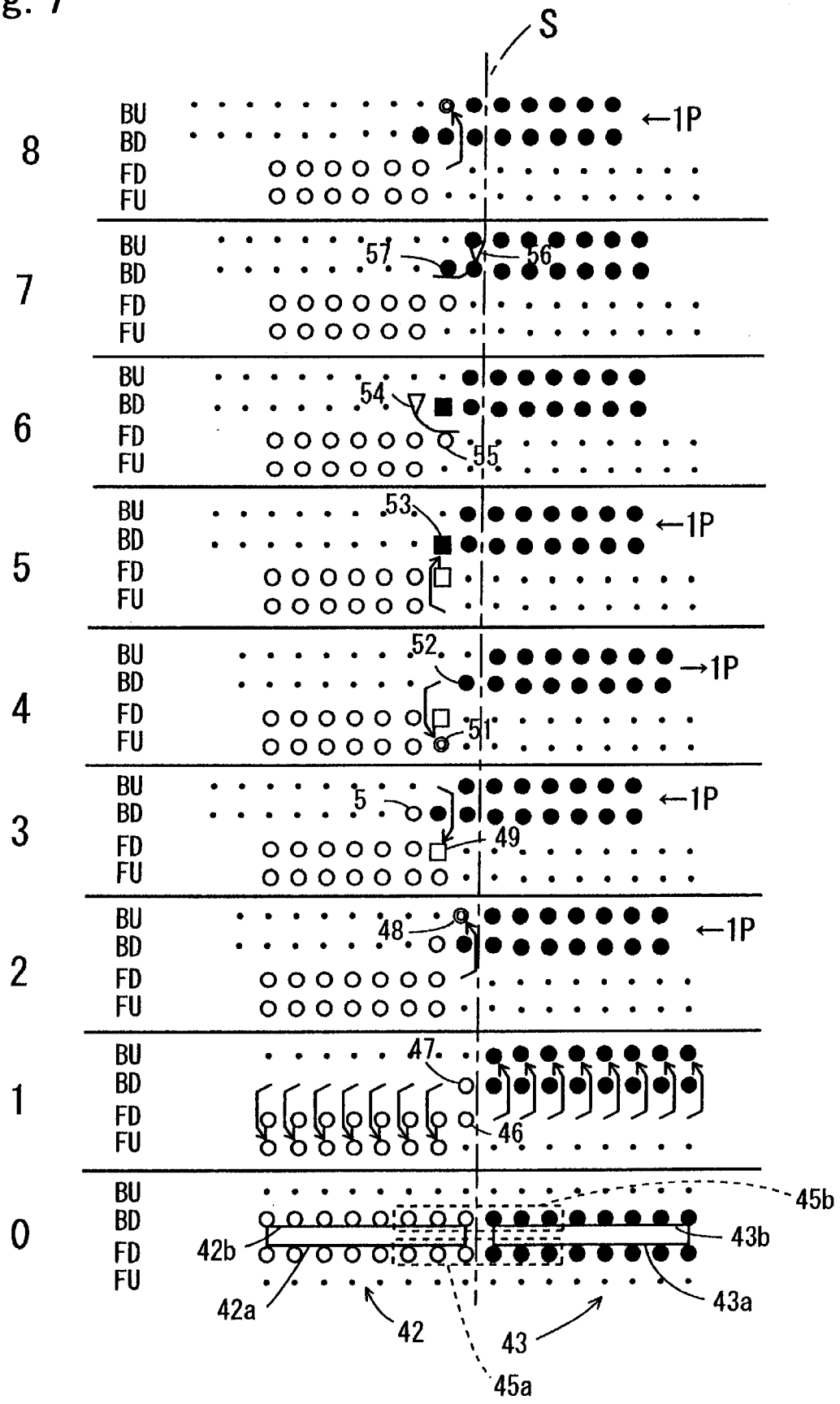
FIG. 7 shows the knitting course diagram showing the joining of the two knitted fabrics in accordance with the second embodiment.
Figure 8:
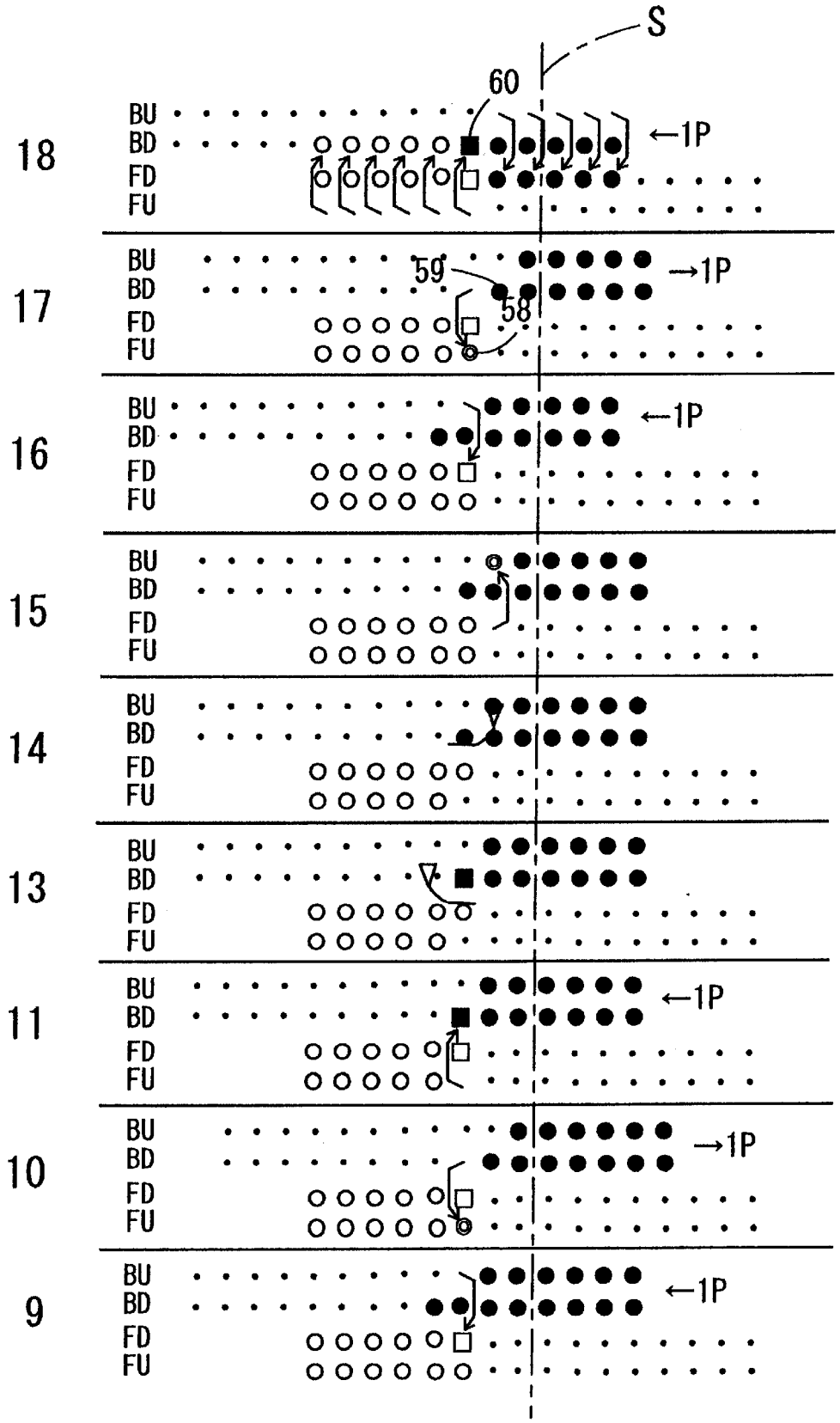
FIG. 8 shows the knitting course diagram showing the joining of the two knitted fabrics in accordance with the second embodiment.
Figure 9:
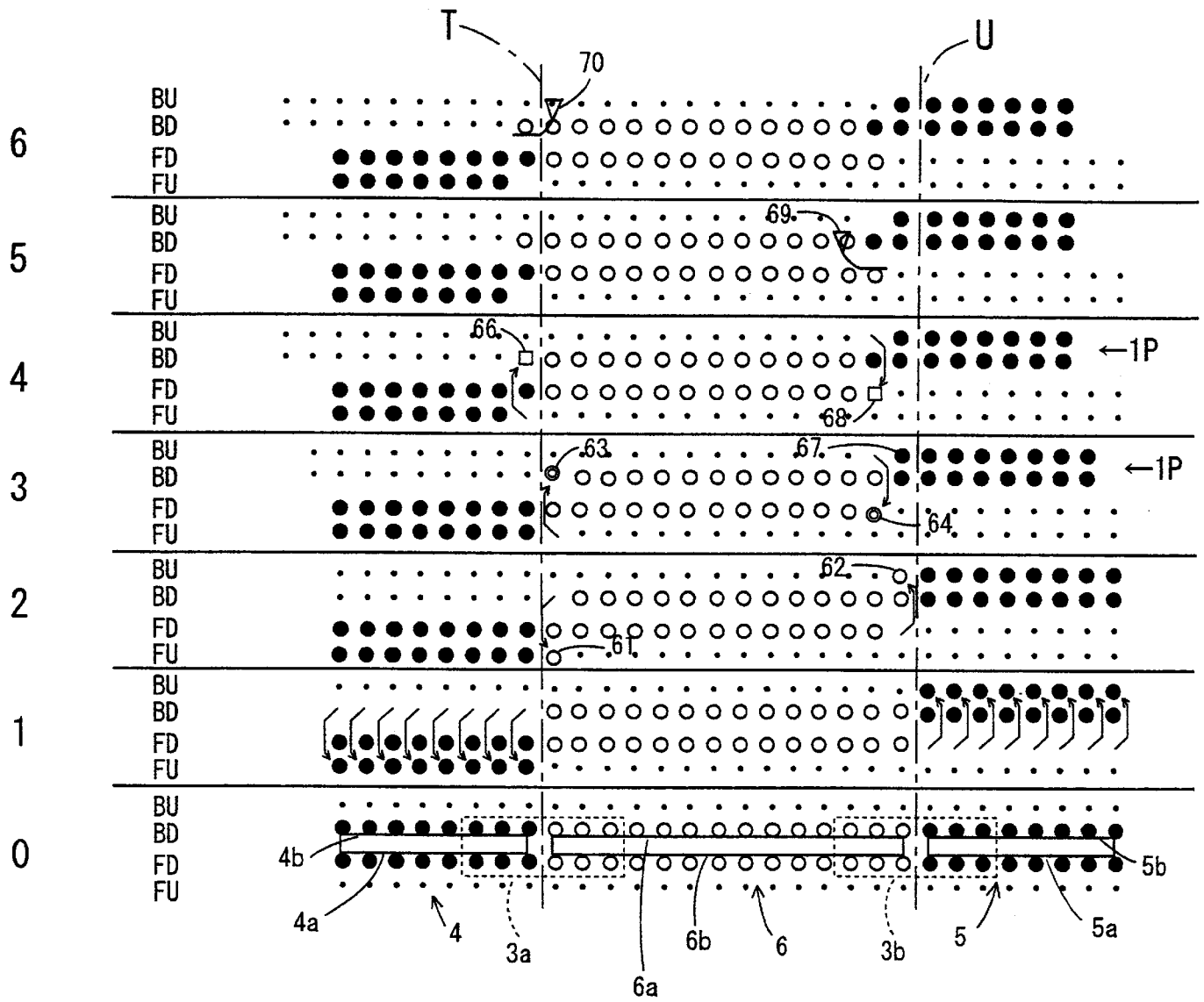
FIG. 9 shows the knitting course diagram showing the joining of three knitted fabrics in accordance with the second embodiment.
Figure 10:
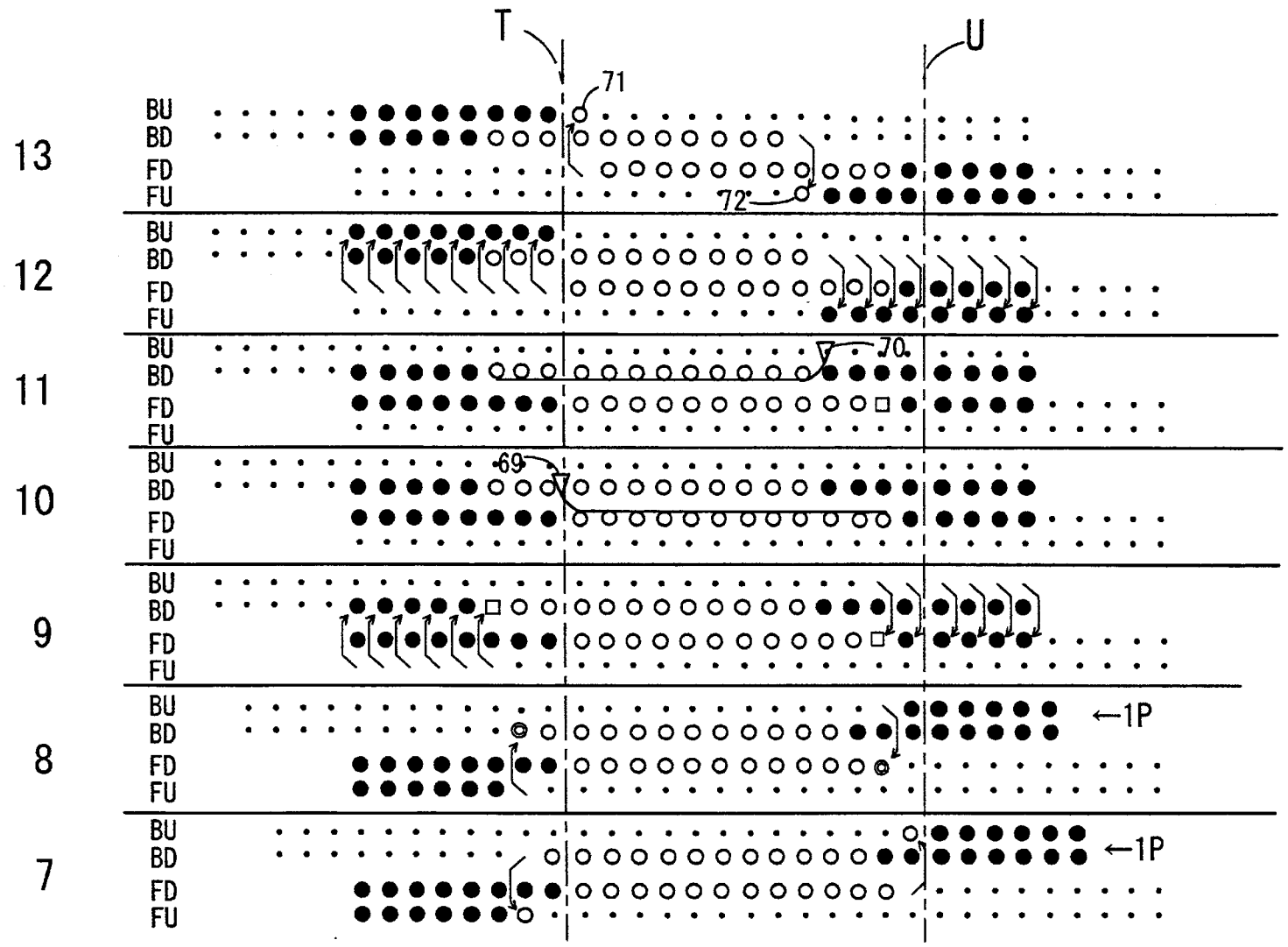
FIG. 10 shows the knitting course diagram showing the joining of three knitted fabrics in accordance with the second embodiment.
Figure 11:
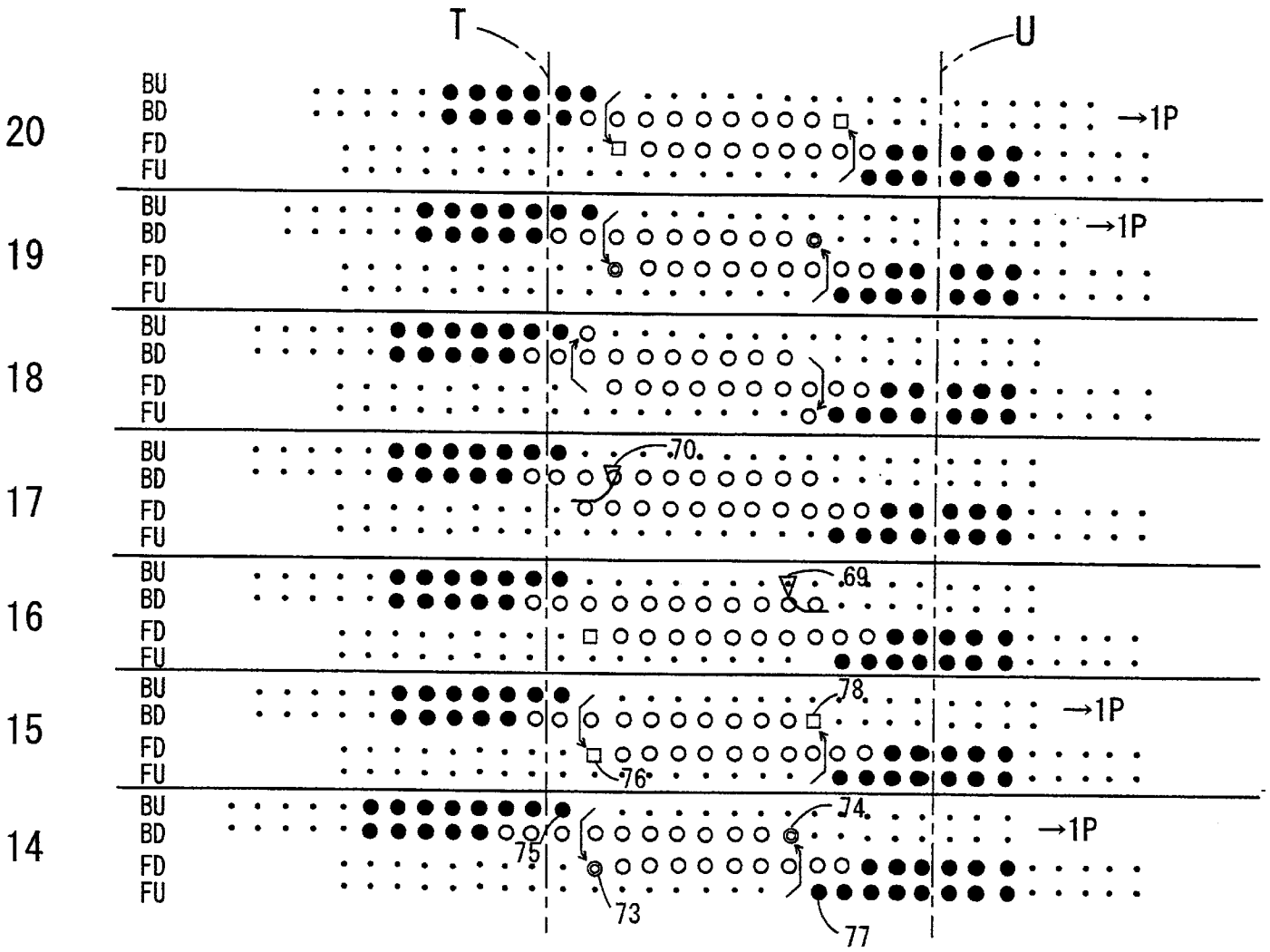
FIG. 11 shows the knitting course diagram showing the joining of the three knitted fabrics in accordance with the second embodiment.
Figure 12:
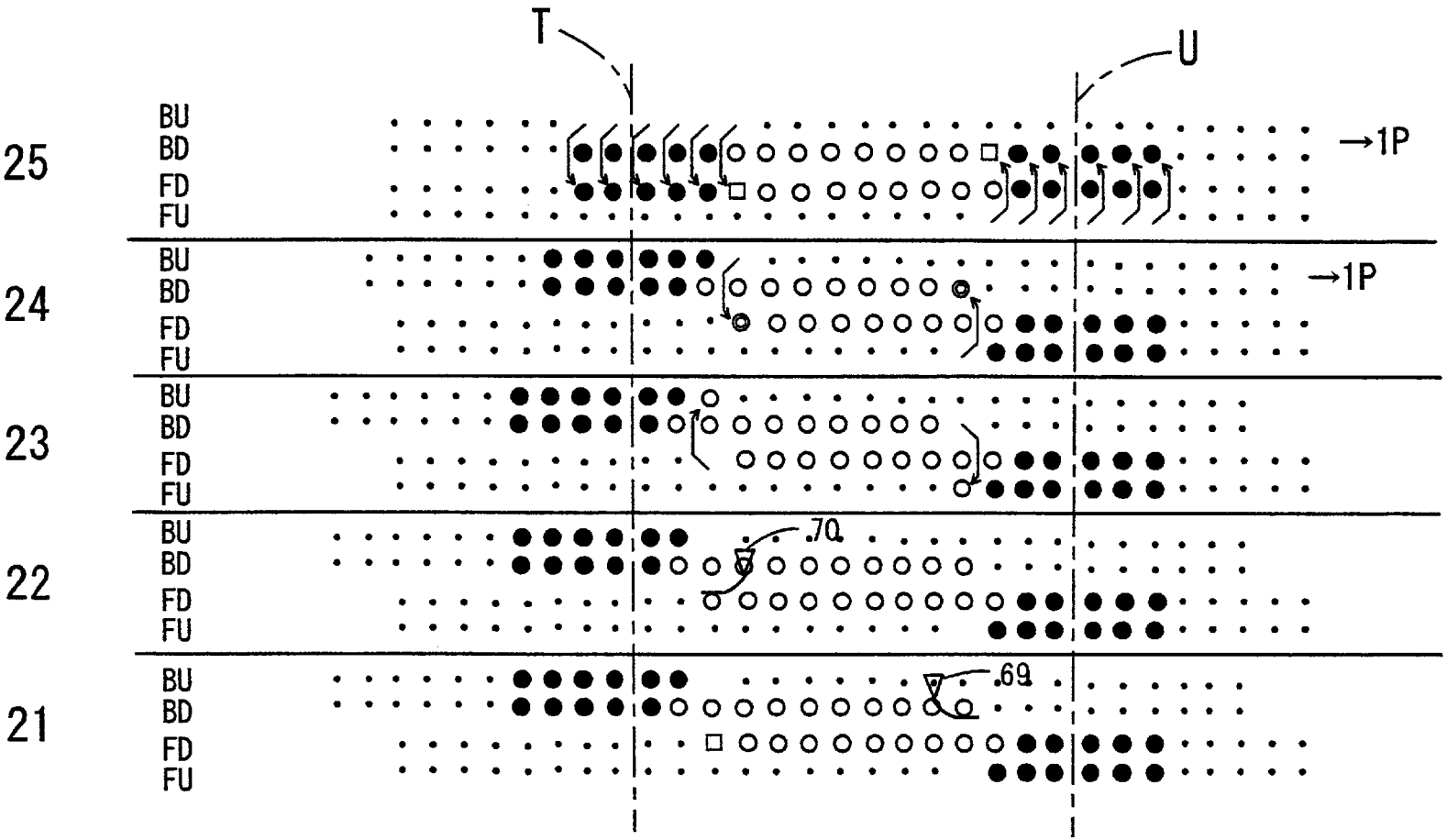
FIG. 12 shows the knitting course diagram showing the joining of the three knitted fabrics in accordance with the second embodiment.

In the following, the knitting for joining together the two knitted fabrics will be described with reference to the knitting course diagrams of FIGS. 7–8, taking the knitting of shorts 41 shown in FIG. 6 for instance. In this embodiment, the knitting process of FIG. 5-*a* wherein the knitting W-X proceed in parallel is described. The shorts 41, which comprises a right leg part 42, a left leg part 43 and a body part 44, has the machi 45*a*, 45*b* formed at a joining point between the right leg part 42 and the body part and at a joining point between the left leg part 43 and the body part. The right leg part 42 corresponds to the second knitted fabric 22 of FIG. 5-*a* and the left leg part 43 corresponds to the first knitted fabric 21 of FIG. 5-*a*. The course 0 of FIG. 7 illustrates the state before the start of forming the machi 45*a*, 45*b*. In this state, the right leg part 42 indicated by white circles and the left leg part 43 indicated by black circles are adjacent to each other. The loops on a front lower needle bed surrounded with a chain line 45*a* are the loops in the joining regions of the front knitted fabric part in which the machi 45*a* is formed, and the loops on a back lower needle bed surrounded with a chain line 45*b* are the loops in the joining regions of the back knitted fabric part in which the machi 45*b* is formed. In FIGS. 7–8, the numerals at the left side indicate the serial number of the courses. FU denotes a front upper needle bed; FD denotes a front lower needle bed; BD denotes a back lower needle bed; and BU denotes a back upper needle bed. A dashed line S indicates a boundary between the right leg part 42 and the left leg part 43 before the start of forming the machi 45*a*, 45*b*. In the course 1, loops of a front left leg part 43*a* are transferred to the back upper needle bed BU and loops of a back right leg part 42*b* are all transferred to the front upper needle bed FU, except a loop of the right leg part 42 at a side end thereof on the left leg part 43 side. In the course 2, after the back needle bed is racked leftward one pitch, a loop 46 of the front right leg part 42*a* at a side end thereof on the left leg part 43 side is laid over a loop 47 of the front left leg part 42*a* at a side end thereof on the right leg part 42 side located on the back upper needle bed BU, to form a double loop 48. In the course 3, after the back needle bed is further racked leftward one pitch, the double loop 48 is transferred to the front lower needle bed FD and is laid over a loop of the right leg part 42 at the side end on the left leg 43 side, to form a triple loop 49. In the course 4, after the back needle bed is racked rightward one pitch, a loop 50 of the back right leg 42*b* at the side end on the left leg 43 side retained on the back lower needle bed BD is transferred to the front upper needle bed FU to form a double loop 51. In the next course 5, after the back needle bed is racked leftward one pitch, the double loop 51 is laid over a loop 52 of the left back leg part 43 at the side end on the right leg 42 side retained on the back lower bed, to form a triple loop 53. In the course 6, the yarn is fed to the triple loop 49 via the yarn feeder 54 to form a loop 55 of the next course. In the course 7, a yarn is fed to the triple loop 53 via another yarn feeder 56 to form a loop 57 of the next course.

In the courses 8 to 14, the same knitting processes as those in the courses 2 to 7 are taken for another target loop. In the next courses 15 to 17, the same knitting processes as those in the courses 2 to 4 are taken. In the course 18, the double loop 58 is laid over a loop 59 of the left back leg part 43*b* at the side end, to form a triple loop 60 and also the loops of the back right leg part 52*b* retained on the front upper needle bed and the loops of the back left leg part 43*b* retained on the back upper needle bed BU are transferred to the back lower needle bed and the front lower needle bed FD, respectively. The machi 45*a*, 45*b* are brought to completion in this manner. In the knitted processes mentioned above, the front left leg part 43*a* is laid over the loops of the front right leg part 42*a*, to form the machi 45*a* at the left side of the fabric, and the back right leg part 42*b* is laid over the loops of the back left leg part 43*b*, to form the machi 45*b* at the right side of the fabric.

Next, the knitting process for joining together three tubular fabrics to form the machi 3*a*, 3*b* in the sweater 1 of FIG. 1 will be described with reference to the knitting course diagrams of FIGS. 9–12. In this embodiment, the knitting W and X of FIGS. 5-*b* and 5-*c* proceed in parallel, first, and, then, the knitting Y and Z proceed in parallel. The course 0 illustrates the state before the start of forming the machi 3*a*, 3*b*. A dashed line T indicates a boundary between the body 6 and the right sleeve 4 before the start of forming the machi 3*a*, 3*b*, and a dashed line U indicates a boundary between the body 6 and the left sleeve 5 before the start of forming the machi. The loops on the left side surrounded with a chain line 3*a* are the loops in the joining regions in which the machi 3*a* is formed, and the loops on the right side surrounded with a chain line 3*b* are the loops in the joining regions in which the machi 3*b* is formed. In the course 1 in which the forming of the machi 3*b* is started, the back right sleeve 4*b* is transferred to the front upper needle bed FU and at the same time the front left sleeve 5*a* is transferred to the back upper needle bed BU. In the course 2, a loop 61 of the back body 6*b* at a side end thereof on the right sleeve 4 side is transferred to the front upper needle bed FU and a loop 62 of the front body 6*a* at a side end thereof on the left sleeve 5 side is transferred to the back upper needle bed BU. In the next course 3, after the back needle bed is racked leftward one pitch, the loop 61 of the back body 6*b* at the side end is transferred to the back lower needle bed BD and is laid over a loop of the back body 6*b* at an inside thereof, to form a double loop 63. In parallel with this, the loop 62 of the front body 6*a* at the side end is transferred to the front lower needle bed FD and is laid over a loop of the front body at an inside thereof, to form a double loop 64. In the course 4, after the back needle bed is further racked leftward one pitch, a loop 65 of the back right sleeve 4*b* at a side end thereof on the body side is transferred to the back lower needle bed and is laid over the double loop 63 to form a triple loop 66. In parallel with this, a loop 67 of the front left sleeve 5*a* at a side end thereof on the body side is transferred to the front needle bed and is laid over the double loop 64 to form a triple loop 68. In the next course 5, a yarn is fed to the triple loop 68 via a yarn feeder 69 to form a loop of the next course, and a yarn is fed to the triple loop 66 via a yarn feeder 70 to form a loop of the next course. In the courses 1 to 6, the knitting for the back body 6*b* to be bound off in the direction of being away from the right sleeve 4 and for joining together the back right sleeve 4*b* and the back body 6*b* and the knitting for the front body 6*a* to be bound off in the direction of being away from the left sleeve 5 and for joining together the front left sleeve 5*a* and the front body 6*a* are performed in parallel. Subsequently, this knitting is repeated a proper number of times according to the widths of the machi 3*a*, 3*b* formed. As a result of this, the machi 3*a*, 3*b* are formed through which the front body 6*a* and the front left sleeve 5*a* are joined together and the back body 6*b* and the back right sleeve 4*b* are joined together. In the courses 7 to 8, the same knitting processes as those in the courses 2 to 3 are taken. In the course 9, when the joining of the front body 6*a* and the front left sleeve 5*a* and the joining of the back body 6*b* and the back right sleeve 4*b* are both completed, the back right sleeve 4*b* retained on the front upper needle bed FU is transferred back to the back lower needle bed BD and, at the same time, the front left sleeve 5*a* retained on the back upper needle bed BU is transferred back to the front lower needle bed FD. After this manner, the knitting of FIG. 5-*b* is completed. In the course 10, the yarn is fed to the front body 6*a* via the yarn feeder 69, and in the course 11, the yarn is fed to the back body 6*b* via the yarn feeder 70. Thereafter, the yarn feeders 69, 70 are each moved to the opposite side to the body 6, for the knitting Y,Z of FIG. 5-*c*.

In the course 12 at which the knitting of FIG. 5-*c* is started, the front right sleeve 4*a* is transferred to the back upper needle bed BU and, at the same time, the back left sleeve 4*b* is transferred to the front upper needle bed FU. In the course 13, a loop 71 of the front body 6*a* at a side end thereof on the right sleeve 4 side is transferred to the back upper needle bed BU and a loop 72 of the back body 6*b* at a side end thereof on the left sleeve 5 side is transferred to the front upper needle bed FU. In the next course 14, after the back needle bed is racked rightward one pitch, the loop 71 of the front body 6*a* at the side end is transferred to the front lower needle bed FD and is laid over a loop of the front body 6*a* at an inside thereof, to form a double loop 73. In parallel with this, the loop 72 of the back body 6*b* at the side end is transferred to the back lower needle bed BD and is laid over a loop of the back body 6*b* at an inside thereof, to form a double loop 74. In the course 15, after the back needle bed is further racked rightward one pitch, a loop 75 of the front right sleeve 4*a* at a side end thereof on the body side is transferred to the front lower needle bed FD and is laid over the double loop 73 to form a triple loop 76. In parallel with this, a loop 77 of the back left sleeve 5*b* at a side end thereof on the body side is transferred to the back upper needle bed BU and is laid over the double loop 74 to form a triple loop 78. In the course 16, the yarn is fed to the triple loop 78 via the yarn feeder 69 to form a loop of the next course, and the yarn is fed to the triple loop 76 via the yarn feeder 70 to form a loop of the next course. In the courses 13 to 17, the knitting for the back body 6*b* to be bound off in the direction of being away from the left sleeve 5 and for joining together the back left sleeve 5*b* and the back body 6*b* are performed in parallel. At the same time, the knitting for the front body 6*a* to be bound off in the direction of being away from the right sleeve 4 and for joining together the front right sleeve 4*a* and the front body 6*a* are performed in parallel. Subsequently, this knitting is repeated a proper number of times according to the widths of the machi formed. As a result of this, the front body 6*a* and the front right sleeve are joined together via the machi and the back body 6*b* and the back left sleeve 5*b* are joined together via the machi. In the courses 18 to 24, the same knitting processes as those in the courses 13 to 17 are taken. In the course 25, when the joining of the front body 6*a* and the front right sleeve 4*a* and the joining of the back body 6*b* and the back left sleeve 5*b* are both completed, the front right sleeve 4*a* retained on the back upper needle bed BU is transferred back to the front lower needle bed FD and, at the same time, the back left sleeve 5*b* retained on the front upper needle bed FU is transferred back to the back lower needle bed BD. After the knitting processes mentioned above, the forming of the machi 3*a*, 3*b* is completed. Subsequently, the knitting in the step D and the subsequent step of FIG. 1 are performed to knit the sweater 1. In this embodiment, since the knitting for joining together the front knitted fabric parts and the knitting for joining together the back knitted fabric parts are performed in parallel, the difference in the number of loops between the front knitted fabric parts and the back knitted fabric parts is not produced. Accordingly, the knitting for joining together the front and back knitted fabric parts can be made without performing the circle knitting. It should be noted that the circle knitting is applicable to the joining of the three knitted fabrics. In this case, the knitting W-Z of FIGS. 5-*b* and 5-*c* can be made independently or the front knitted fabric parts and the back knitted fabric parts can be made different in width of the machi.

Third Embodiment

The third embodiment will be described with reference to FIG. 13. In the third embodiment, the tubular knitted fabrics to be joined together are made to circle in the opposite direction in the circle knitting, so that the loops in the joining rejoins of two tubular fabrics are retained on the same needle bed. The third embodiment provides the method for joining together tubular fabrics by using the knitting in which a tubular fabric to be subsequently joined is bound off from one side end thereof toward the other side end thereof and the knitting in which the loops in the joining region of another tubular fabric are laid over the loops in the joining region of the sequentially joined tubular fabric sequentially from a side end thereof in such a manner as to join together the front knitted fabric parts and join together the back knitted fabric parts. In the third embodiment, the knitting process in which the loops in the adjacent joining regions are laid over each other and the bind-off process proceed concurrently, and the process for joining together the joining regions of the front knitted fabric parts and the process for joining together the joining regions of the back knitted fabric parts proceed sequentially.

Figure 13:
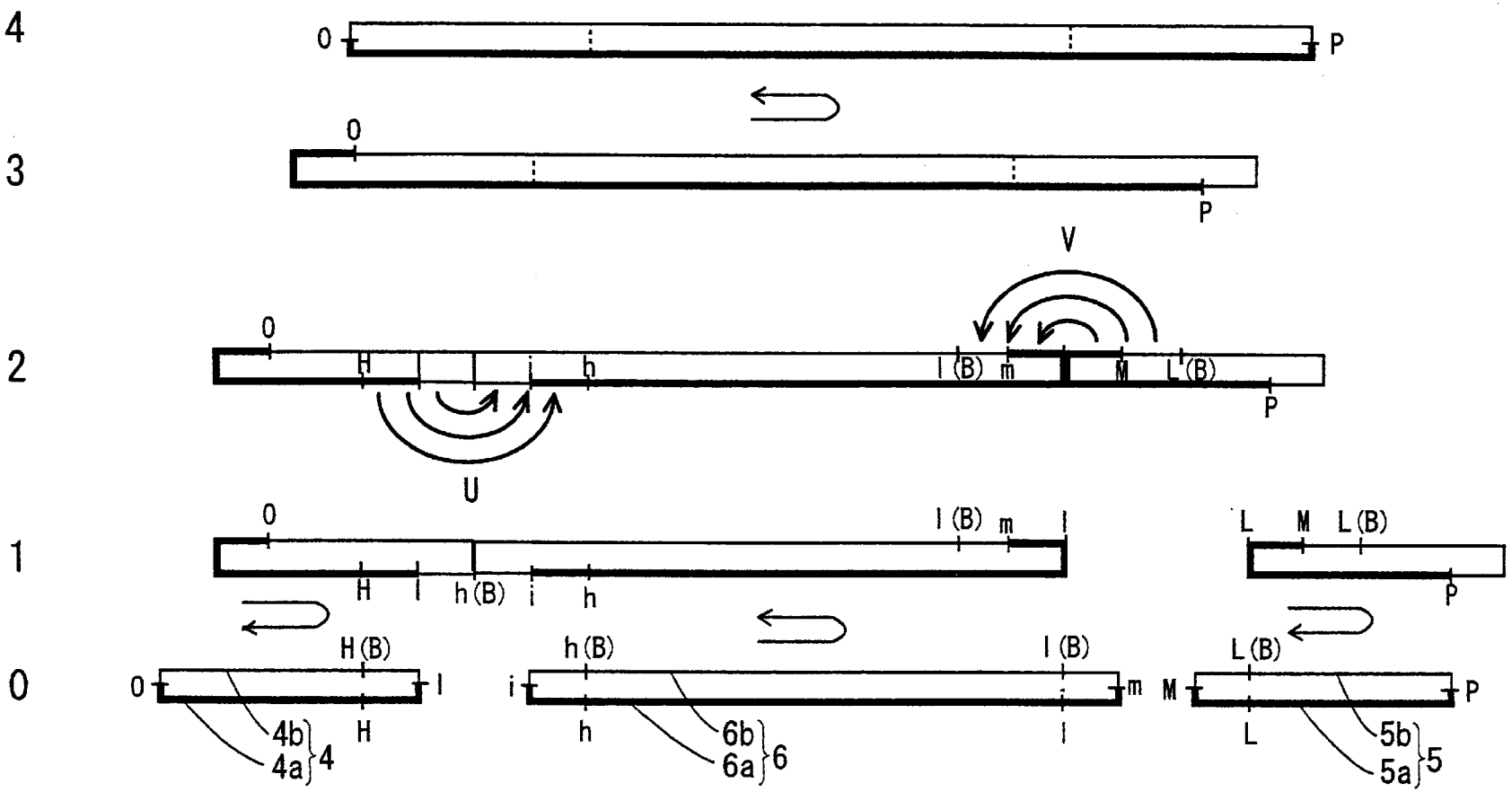
FIG. 13 is a diagram illustrating the knitting steps of the third embodiment for forming the machi in the sweater.

In FIG. 13, the front knitted fabric parts are depicted by a bold line, and the back knitted fabric parts are depicted by a thin line, as is the case with FIG. 3. The alphabets in FIG. 13 correspond to the alphabets at the points of the sweater of FIG. 1. Although the joining method of the third embodiment is applicable to the joining of two knitted fabrics as well as three knitted fabrics, description on the joining of the three knitted fabrics to form the machi 3*a*, 3*b* in the sweater 1 will be given below.

In the third embodiment, the circle knitting is performed from the step 0 illustrating the state before the start of forming the machi 3*a*, 3*b* to the state of the step 1. The body 6 is made to circle in the counterclockwise direction, so that the joining region of the right sleeve is retained on the front needle bed and the joining region of the left sleeve is retained on the back needle bed. The right sleeve 4 and the left sleeve 5 are made to circle in the clockwise direction which is opposite to the direction for the body to be circled. In the third embodiment, the body 6 is made to circle counterclockwise but the right and left sleeves 4, 5 are made to circle clockwise, for the reason of which the racking direction of the needle bed required for the right and left sleeves 4, 5 to circle and the racking direction of the needle bed required for the body 6 to circle are different from each other. Consequently, both the right and left sleeves 4, 5 and the body 6 cannot be made to circle at the same time. Due to this, when the right and left sleeves 4, 5 are made to circle, the body 6 is retained on either of the front needle bed and the back needle bed, while on the other hand, when the body 6 is made to circle, the right and left sleeves 4, 5 are retained on either of the front needle bed and the back needle bed. As a result of the right and left sleeves 4, 5 and the body 6 being made to circle in the manner as mentioned above, the loops in the joining region of the right sleeve 4 are all retained on the front needle bed and the loops in the joining region of the left sleeve 5 are all retained on the back needle bed. Likewise, the loops in the joining region of the body on the right sleeve side are retained on the same front needle bed and the loops in the joining region of the body on the left sleeve side are retained on the same back needle bed. In the next step 2, the body 6 and the right and left sleeves 4, 5 are abutted with each other, so that the joining regions of the sleeves 4, 5 and the joining regions of the body 6 are abutted with each other, as is the case with FIG. 4-*c*. Subsequently, the same knitting U, V as those in the step 12 and the subsequent steps of the second embodiment are performed in parallel to join together the joining regions of the right and left sleeves 4, 5 and the joining regions of the body, so as to form the machi 3*a*, 3*b*. At the completion of the forming of the machi 3*a*, 3*b*, the tubular fabric formed by joining together the right and left sleeves 4, 5 and the body 6 is put in the clockwise circuled state, as illustrated in the step 3. In the step 4, the circle knitting is performed for making the tubular fabric circle counterclockwise until the boundary O between the front knitted fabric part and the back knitted fabric part and the boundary P therebetween reach the ends of the tubular fabric, respectively. Subsequently, the step D and the subsequent step of FIG. 1 are performed to knit the sweater 1. In the third embodiment, the knitting U and V of the step 2 may be made sequentially by providing the circle knitting and the joining knitting in parallel. In the case where two knitted fabrics are joined together by using the method of the third embodiment, the circle knitting is performed in parallel with the joining knitting. In the third embodiment as well, the machi 3*a*, 3*b* formed in the front knitted fabric portion and the back knitted fabric portion may have different number of loops.

Figure 14:
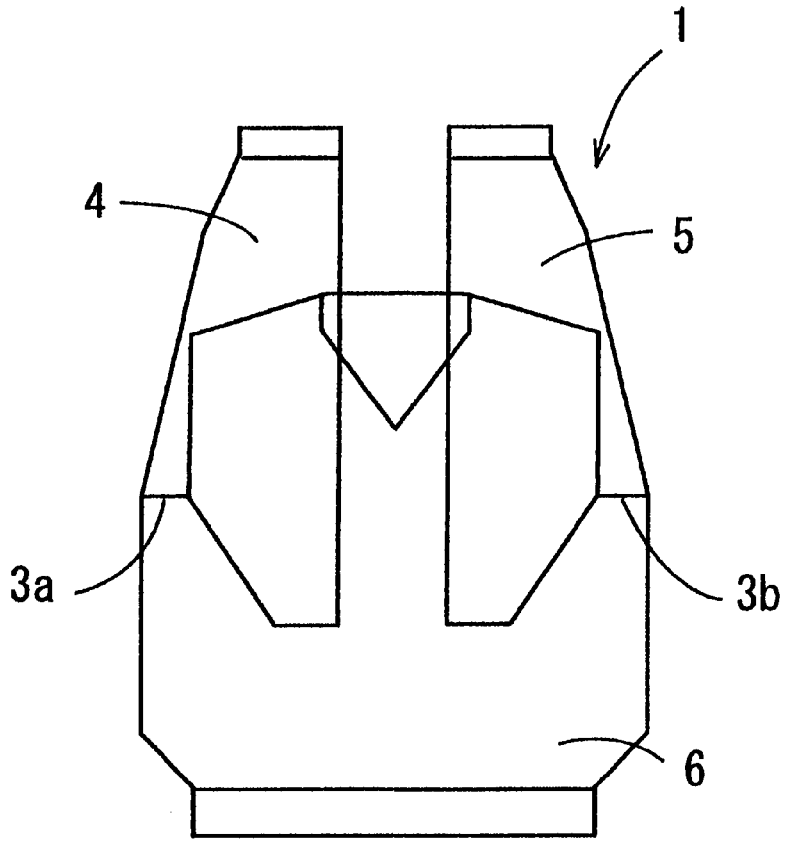
FIG. 14 is a drawing showing the upper limit positions of the sleeves of the sweater in which the machi of the present invention are formed.
Figure 15:
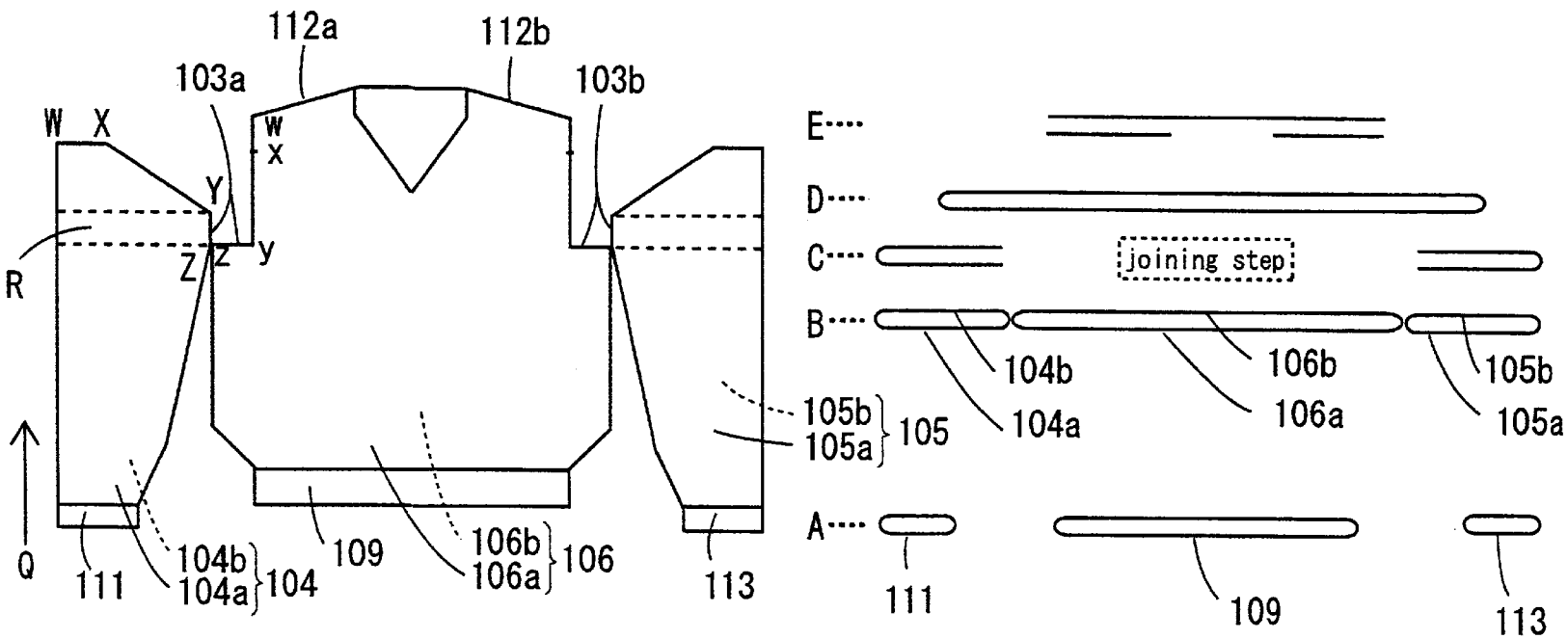
FIG. 15 shows a development of the sweater in which conventional machi are formed and a knitting process drawing of the same.
Figure 16:
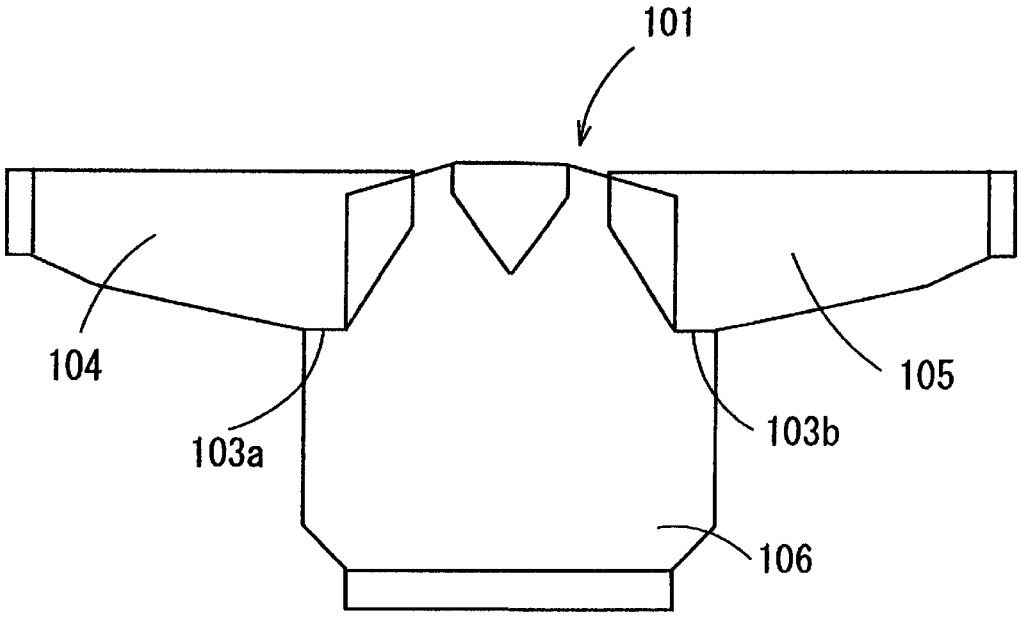
FIG. 16 is a drawing showing the upper limit positions of the sleeves of the sweater in which the machi are formed in the conventional knitting method.

When the tubular fabrics are joined together in the method of any one of the first embodiment to the third embodiment, the loops in the joining region of one tubular fabric to be joined, which region comprise a proper number of wale and are located at the side end portion thereof, and the loops in the joining region of another tubular fabric are bound off in such a state that the loops located at a near side from the boundary between the front knitted fabric part and the back knitted fabric part are combined with each other and the loops located at a far side therefrom are combined with each other and thereby the machi are formed at the joining point. In the knitted fabric having the machi formed in this manner, when the sleeves 4, 5 are rotated from the body 6 centered on the machi 3*a*, 3*b* in the spread-out direction, the sleeves 4, 5 can be allowed to rotate up to a larger angle, as shown in FIG. 14, as compared with the sleeves joined in the conventional, method. This can produce knitwear having a high degree of freedom of motion of the human body and comfortableness to wear.

In addition, when the machi of the front knitted fabric part and the machi of the back knitted fabric part are made to have different width, a three dimensional silhouette having different peripheral length can be given to the knitwear to thereby produce knitwear suitable to one's figure and comfortable to wear.

It should be noted that the embodiments are illustrated by way of example and no limitation is imposed on the matters, such as the knitting sequence and the control of the yarn feeders, that could be easily varied or modified by persons skilled in the art based on their ordinal knowledge and equivalent.

Capabilities of Exploitation in Industry

According to the joining methods for joining together the tubular fabrics, the loops in the final course of one tubular fabric to be joined and the loops in the final course of the joining region of another tubular fabric are laid over each other in such a relation that the loops located at a near side from a boundary between the front knitted fabric part and the back knitted fabric part are combined with each other and the loops located at a far side therefrom are combined with each other. This enables the one tubular fabric to rotate up to a larger angle than usual from the other tubular fabric, centered on the machi, in the direction in which the space between the both knitted fabrics is widened. This can provide knitwear having a high degree of freedom of motion of the human body and comfortableness to wear.

What is claimed is:

1. A knitted fabric joining method for knitting and joining together at least two tubular fabrics in an overlapping relation by using a flat knitting machine, each said fabric comprising front and back knitted fabric parts opposite to each other in front and back, said flat knitting machine comprising at least a pair of first and second needle beds, which are extended laterally and confront each other in front and back, each needle bed has a large number of needles and at least either of said needle beds can be racked laterally to transfer loops between the front and back needle beds, the method comprising the following steps:

laying loops of a final course in a joining region of a first tubular fabric to be joined, which comprise a number of wale and are located at a side end portion thereof, and loops of a final course in a joining region of a second tubular fabric over each other such that the loops located at a near side from a boundary between the front knitted fabric part and the back knitted fabric part are combined with each other and the loops located at a far side from said boundary are combined with each other, so as to be bound off, thereby forming a machi at a joining point of the first and second tubular fabrics; and knitting an integrated tubular fabric continuously from that joined tubular fabric.

2. The knitted fabric joining method according to claim 1, which comprises the steps:

a) in the process of knitting first and second knitted fabrics in a half-gauge knitting and joining together those knitted fabrics, racking one of said first and second needle beds in a first direction with respect to the other needle bed and then transferring a loop of the first knitted fabric at a side end thereof on the second knitted fabric side, which loop is retained on the first needle bed, to outside of a loop of the first knitted fabric at a side end thereof retained on the second needle bed, and transferring a loop of the first knitted fabric at a side end thereof opposite to the side end on the second knitted fabric side, which loop is retained on the second needle bed, to outside of a loop of the first knitted fabric at the side end thereof retained on the first needle bed, repeatedly, thereby the first knitted fabric is made to circle in the first direction so that the loops in the joining region of the first knitted fabric can all be retained on the second needle bed, b) transferring a loop of the second knitted fabric at a side end thereof on the first knitted fabric side, which loop is retained on the second needle bed, to outside of a loop of the second knitted fabric at a side end thereof retained on the first needle bed and transferring a loop of the second knitted fabric at a side end thereof opposite to the side end on the first knitted fabric side, which loop is retained on the first needle bed, to outside of the loop of the second knitted fabric at a side end thereof retained on the second needle bed, repeatedly, thereby the second knitted fabric is made to circle in the first direction so that the loops in the joining region of the second knitted fabric can all be retained on the first needle bed, c) retaining all the loops of the first knitted fabric on the first needle bed; retaining all the loops of the second knitted fabric on the second needle bed; after the one needle bed is racked in the first direction so that a loop in the joining region of the first knitted fabric and a loop in the joining region of the second knitted fabric can correspond in position to each other in front and back, laying the loops in the joining regions of the first and second knitted fabrics over each other so as to be bound off, and d) racking the one needle bed in the second direction and then transferring a loop of the tubular fabric into which the first knitted fabric and the second knitted fabric are joined and which is retained on the second needle bed to outside of a loop of the tubular fabric at a side end thereof retained on the first needle bed, and transferring a loop of the tubular fabric at a side end thereof opposite to the side end on the first needle bed to outside of a loop of the tubular fabric at a side end thereof on the second needle bed, thereby making the tubular fabric to circle in the second direction opposite to the first direction.

3. The knitted fabric joining method according to claim 1, which comprises the steps:

a) transferring the front knitted fabric part of the first knitted fabric to the second needle bed and transferring the back knitted fabric part of the second knitted fabric to the first needle bed, b) while either of the front needle bed and the back needle bed is racked in a lateral direction, sequentially laying loops in the joining region of the front knitted fabric part of the first knitted fabric over loops of the front knitted fabric part of the second knitted fabric at a side end thereof, in parallel with loops in the joining region of the front knitted fabric part of the second knitted fabric being bound off in the direction of being away from the first knitted fabric, and c) while either of the front needle bed and the back needle bed is racked in the lateral direction, sequentially laying loops in the joining region of the back knitted fabric part of the second knitted fabric over loops of the back knitted fabric part of the first knitted fabric at a side end thereof, in parallel with loops in the joining region of the back knitted fabric part of the first knitted fabric being bound off in the direction of being away from the second knitted fabric, thereby joining the first knitted fabric and the second knitted fabric together.

4. The knitted fabric joining method according to claim 1, which comprises the steps:

a) knitting the first knitted fabric, the second knitted fabric and a third knitted fabric in such a relation that the first knitted fabric can be positioned between the second and third knitted fabrics, and transferring the front knitted fabric part of the second knitted fabric to the first needle bed and transferring the back knitted fabric part of the third knitted fabric to the second needle bed, b) while either of the front needle bed and the back needle bed is racked in a first direction, binding off loops in the joining region of the front knitted fabric part of the first knitted fabric on the second knitted fabric side off in the direction of being away from the second knitted fabric and laying loops in the joining region of the front knitted fabric part of the second knitted fabric and loops of the front knitted fabric part of the first knitted fabric at a side end thereof over each other, in parallel, and binding off loops in the joining region of the back knitted fabric part of the first knitted fabric on the third knitted fabric side in the direction of being away from the third knitted fabric and laying loops in the joining region of the back knitted fabric part of the third knitted fabric and loops of the back knitted fabric part of the first knitted fabric at a side end thereof over each other, in parallel, c) transferring the back knitted fabric part of the second knitted fabric is transferred to the second needle bed and the front knitted fabric part of the third knitted fabric to the first needle bed, and d) while the either needle bed is racked in a second direction, binding off loops in the joining region of the back knitted fabric part of the first knitted fabric on the second knitted fabric side in the direction away from the second knitted fabric and laying loops in the joining region of the back knitted fabric part of the second knitted fabric and loops of the back knitted fabric part of the first knitted fabric at a side end thereof over each other, in parallel, and binding off loops in the joining region of the front knitted fabric part of the first knitted fabric on the third knitted fabric side are in the direction away from the third knitted fabric and laying loops in the joining region of the back knitted fabric part of the third knitted fabric and loops of the front knitted fabric part of the first knitted fabric at a side end thereof over each other, in parallel at both ends of the first knitted fabric.

5. The knitted fabric joining method according to claim 1, which comprises the steps:

a) racking one of first and second needle beds in a first direction with respect to the other needle bed and then transferring a loop of the first knitted fabric at a side end thereof on the second knitted fabric side, which loop is retained on the first needle bed, to outside of a loop of the first knitted fabric at a side end thereof retained on the second needle bed and a transferring loop of the first knitted fabric at a side end thereof opposite to the side end on the second knitted fabric side, which loop is retained on the second needle bed, to outside of the loop located at the side end of the first knitted fabric retained on the first needle bed, repeatedly, so that the first knitted fabric is made to circle in the first direction so that the loops in the joining region of the first knitted fabric can all be retained on the second needle bed, b) racking the one needle bed in a second direction and then transferring a loop of the second knitted fabric at a side end thereof on the first knitted fabric side, which loop is retained on the first needle bed, to outside of a loop of the second knitted fabric at a side end thereof retained on the second needle bed and transferring a loop of the second knitted fabric at a side end thereof opposite to the side end on the first knitted fabric side, which loop is retained on the second needle bed, to outside of the loop located at the side end of the second knitted fabric retained on the first needle bed, repeatedly, so that the second knitted fabric is made to circle in the second direction so that the loops in the joining region of the second knitted fabric can all be retained on the second needle bed, c) while either of the front and back needle beds is racked in the first direction, binding off loops in the joining region of the first knitted fabric in the direction away from the second knitted fabric, and laying loops in the joining region of the second knitted fabric and loops of the first knitted fabric at a side end thereof retained on the second needle bed each other, to join together the joining region of the second knitted fabric and the joining region of the first knitted fabric, and d) while the either needle bed is racked in the second direction, transferring a loop of the first knitted fabric retained on the first needle bed to outside of a loop of the first knitted fabric at a side end thereof retained on the second needle bed, and transferring a loop of the first knitted fabric at a side end thereof retained on the second needle bed to outside of the loop of the first knitted fabric at a side end thereof retained on the first needle bed, repeatedly, thereby the tubular fabric is made to circle in the first direction.

6. The knitted fabric joining method according to claim 1, which comprises the steps:

a) knitting the first knitted fabric, the second knitted fabric and a third knitted fabric such that the first knitted fabric can be positioned between the second and third knitted fabrics; and after one needle bed is racked in a first direction with respect to the other needle bed, transferring a loop of the first knitted fabric at a side end thereof on the second knitted fabric side, which loop is retained on the second needle bed, to outside of a loop of the first knitted fabric at a side end thereof retained on the first needle bed and transferring a loop of the first knitted fabric at a side end thereof on the third knitted fabric side, which loop is retained on the first needle bed, to outside of a loop of the first knitted fabric at a side thereof on the third knitted fabric side, which loop is retained on the second needle bed, repeatedly, thereby the first knitted fabric is made to circle in the first direction so that the loops in the joining region of the first knitted fabric on the second knitted fabric side can be retained on the first needle bed and the loops in the joining region of the first knitted fabric on the third knitted fabric side can be retained on the second needle bed, b) after the needle bed is racked in a second direction,(i) transferring a loop in a joining region of the second knitted fabric at a side end thereof on the first knitted fabric side, which loop is retained on the second needle bed, to outside of a loop of the second knitted fabric at a side end thereof retained on the first needle bed and transferring a loop of the second knitted fabric at a side end thereof opposite to the first knitted fabric, which loop is retained on the first needle bed, to outside of a loop of the second knitted fabric at a side end thereof retained on the second needle bed, repeatedly, thereby the second knitted fabric is made to circle in the second direction so that the loops in the joining region of the second knitted fabric can be retained on the first needle bed; and (ii) transferring a loop in a joining region of the third knitted fabric at a side end thereof on the first knitted fabric side, which loop is retained on the first needle bed, to outside of a loop of the third knitted fabric at a side end thereof retained on the second needle bed and transferring a loop of the third knitted fabric at a side end thereof opposite to the first knitted fabric, which loop is retained on the second needle bed, to outside of a loop of the third knitted fabric at a side end thereof retained on the first needle bed, repeatedly, thereby the third knitted fabric is made to circle in the second direction so that the loops in the joining region of the third knitted fabric can be retained on the second needle bed are performed in parallel, c) while either of the front needle bed and the back needle bed is racked in the first direction, binding off loops in the joining region of the first knitted fabric on the second knitted fabric side in the direction away from the second knitted fabric and laying loops in the joining region of the second knitted fabric and loops of the first knitted fabric at a side end thereof over each other, in parallel, and binding off loops in the joining region of the first knitted fabric on the third knitted fabric side in the direction of being away from the third knitted fabric and laying loops in the joining region of the third knitted fabric and loops of the first knitted fabric at a side end thereof over each other, in parallel, and d) while the either needle bed is racked in the second direction, transferring a loop of the tubular fabric at a side end thereof retained on the first needle bed, the tubular fabric being formed by joining together the first, second and third knitted fabrics, to outside of a loop of the tubular fabric at a side end thereof retained on the second bed, and transferring a loop of the tubular fabric at a side end thereof retained on the second needle bed is transferred to outside of a loop of the tubular fabric at a side end thereof retained on the first needle bed, repeatedly, thereby the tubular fabric is made to circle in the second direction.

7. The knitted fabric joining method according to claim 3, wherein the joining of the joining regions of the front knitted fabric part and the joining of the joining regions of the back knitted fabric part are performed independently and a circle knitting wherein a loop of the knitted fabric having a larger number of loops retained on either of the needle beds is transferred to outside of a loop of the knitted fabric retained on the opposite needle bed is performed in parallel with the joining knitting.

8. The knitted fabric joining method according to claim 4, wherein the joining between the first knitted fabric and the second knitted fabric and the joining between the first knitted fabric and the third knitted fabric and/or the joining of the front knitted fabric parts and the joining of the back knitted fabric parts are performed independently and a circle knitting wherein a loop of the knitted fabric having a larger number of loops retained on either of the needle beds is transferred to outside of a loop of the knitted fabric retained on the opposite needle bed is performed in parallel with the joining knitting.

9. The knitted fabric joining method according to claim 1, wherein the number of loops in the joining region of the front knitted fabric part and the number of loops in the joining region of the back knitted fabric are made different from each other.

10. A knitted fabric formed by joining together at least two tubular fabrics, each comprising front and back knitted fabric parts knitted opposite to each other in front and back, by using a flat knitting machine comprising at least a pair of first and second needle beds, which are extended laterally and confront each other in front and back; each of which has a large number of needles; and at least either of which can be racked laterally to transfer loops between the front and back needle beds, wherein loops of a final course in a joining region of a first tubular fabric to be joined, which comprise a number of wale and are located at a side end portion thereof, and loops of a final course in a joining region of second tubular fabric are laid over each other in such a relation that the loops located at a near side from a boundary between the front knitted fabric part and the back knitted fabric part are combined with each other and the loops located at a far side from the boundary are combined with each other, and are bound off, thereby a machi is formed in the knitted fabric and an integrated tubular fabric knitted continuously from that joined tubular fabric.

11. The knitted fabric according to claim 10, wherein the at least two tubular fabrics are a right leg part and a left leg part of a legwear.

12. The knitted fabric according to claim 10, wherein the at least two tubular fabrics are a body and right and left sleeves of a sweater.

* * * * *